US005201651A

United States Patent [19]

Niksic et al.

[11] Patent Number: 5,201,651

[45] Date of Patent: Apr. 13, 1993

[54] CONSTRUCTION HEATER AND METHOD OF MANUFACTURE OF HEATER

[75] Inventors: Mark R. Niksic, Bailey, Colo.; Charles Hokes, Seven Hills, Ohio

[73] Assignee: T.A. Pelsue Company, Englewood, Colo.

[21] Appl. No.: 667,794

[22] Filed: Mar. 11, 1991

[51] Int. Cl.[5] ..... F23N 3/00

[52] U.S. Cl. ..... 431/12; 126/116 A; 126/110 B; 126/116 R

[58] Field of Search ..... 431/12, 354; 126/110 B, 126/110 C, 99 D, 93, 116 A, 116 R

[56] References Cited

U.S. PATENT DOCUMENTS

| | | | |
|---|---|---|---|
| 2,561,934 | 7/1951 | Mayo | 126/93 |
| 2,811,962 | 11/1957 | Pelsue et al. | 126/110 |
| 3,747,586 | 7/1973 | Weiss | 126/110 B |
| 3,757,767 | 9/1973 | Ito et al. | 126/110 B |
| 3,765,398 | 10/1973 | Morris | 126/110 B |
| 3,916,870 | 11/1975 | Beavers | 126/110 B |
| 4,108,143 | 8/1978 | Pelsue et al. | 126/110 B |
| 4,221,557 | 9/1980 | Jalics | 431/22 |
| 4,427,367 | 1/1984 | Yagisawa | 431/354 |
| 4,645,450 | 2/1987 | West | 431/12 |
| 4,651,711 | 3/1987 | Velie | 126/110 C |
| 4,708,636 | 11/1987 | Johnson | 431/12 X |
| 4,848,313 | 7/1989 | Velie | 126/110 C |
| 5,052,367 | 10/1991 | Beavers et al. | 126/110 B |

*Primary Examiner*—Larry Jones

*Attorney, Agent, or Firm*—Rothgerber, Appel, Powers & Johnson

[57] ABSTRACT

A gas-fired construction heater which meets the applicable ANSI Standard and operates to supply heated air separately from products of combustion. The products of combustion are permitted to contain no more than a specified percent of carbon monoxide when uncontrolled heater operating conditions are within predetermined ranges. The uncontrolled operating conditions include variations in input rate and supply voltage. A combustion chamber produces the products of combustion and has primary and secondary combustion zones. A heat exchanger receives the products of combustion and transfers heat therefrom to fresh air to be heated. The chamber and the heat exchanger define a tertiary combustion zone. Inlets supply a separate natural combustion draft to each of the primary and tertiary combustion zones. The inlets include a first and a third fixed-area inlet for respectively supplying the separate natural drafts to the primary and tertiary combustion zones. An additional fixed-area inlet supplies forced draft and natural draft to the secondary combustion zone. The fixed-area of each of these inlets is selected so that the specified percent is not exceeded during operation of the heater when the uncontrolled variation of either the input rate or the supply voltage is within its respective predetermined range. When the uncontrolled variations are outside of the respective predetermined ranges, the heater is turned off.

8 Claims, 14 Drawing Sheets

CONSTRUCTION HEATER AND METHOD OF MANUFACTURE OF HEATER

BACKGROUND OF THE INVENTION

1. Field of the Invention

This invention relates to heaters for construction sites and more particularly to providing a gas-fired construction heater that complies with nationally-recognized standards.

2. Discussion of Prior Art

In the past, a major telephone company approved certain types of gas-fired construction heaters based on its standards (the "Bell Standards"). Heaters complying with such standards are referred to in the manual "Outside Plant Construction—Safety, Tools, General;" No. 200-326, Issue 2, December 1979, published by Western Electric Company, Incorporated for American Telephone and Telegraph Company. Such heaters were used by many telephone operating companies in the maintenance of telephone equipment. Such operating companies would only purchase heaters that had such approval. Therefore, manufacturers sought such approval for their gas-fired construction heaters.

There have been major changes in the organization of the major telephone company in the United States of America. One result of these changes is that no single telephone company continues to set a nationally-recognized standard for these types of gas-fired construction heaters. Consequently, manufacturers of such heaters have sought a different way of assuring their customers that such types of heaters are suitable for the customers' purposes, such as construction and use in maintaining telephone equipment. For example, for one type of gas-fired construction heater sold in the United States of America, one possible way of providing such assurance is to design the gas-fired construction heater so as to comply with applicable standards of the American National Standards Institute ("ANSI"). The current ANSI Standard for gas-fired construction heaters is identified as ANSI Z83.7b-1989 (the "ANSI Standard"). The ANSI Standard is used by equipment certifying organizations, such as the American Gas Association and the Underwriters Laboratories. These organizations test equipment, such as gas-fired construction heaters, and certify the equipment if the equipment meets the ANSI Standard. As to gas-fired construction heaters to be sold in Canada, the Canadian Gas Association ("CGA") has established many standards, which currently are different from the ANSI Standard.

However, the ANSI Standard is in a number of respects more stringent than both the Bell Standards and the current CGA standards. For example, the ANSI Standard will not permit a gas-fired construction heater to have a manually adjustable primary combustion air inlet. As a result, personnel using a gas-fired construction heater conforming to the ANSI Standards in the field will not be able to adjust primary combustion air flow in the heater according to actual field conditions.

Further, the ANSI Standard requires such a gas-fired construction heater to either operate acceptably or shut itself off, and the acceptable operation must occur despite variations in uncontrolled operating conditions within predetermined ranges. For example, gas-fired construction heaters are designed using a standard heat value of 2500 BTU per cubic foot of propane burned. A gas-fired construction heater that is so designed and "rated" for 45,000 BTU would burn 18 cubic feet of propane per hour. That amount of propane would be supplied by selecting (1) the size of the burner orifices and (2) the standard gas pressure in the manifold ("manifold pressure") that supplies gas for the burner, with the selections taking into consideration the barometric pressure under which the burner is to operate. The term "input rate" as used herein indicates fuel supply to the burner at a standard manifold pressure for a particular size burner orifice, a known heat value of the fuel, operation of the burner at a specified barometric pressure and for a given temperature of fuel admitted to the burner. The "normal input rate" is the input rate of such heater as specified by the manufacturer of such heater. The ANSI Standard requires gas-fired construction heaters to operate in a range of from 85% to 112% of the normal input rate without producing more than 0.08% carbon monoxide ("CO") air-free in a random sample of the combustion products of the gas-fired construction heaters (the "CO Standard"). Thus, the range in which the input rate of the gas-fired construction heaters must operate while meeting the CO Standard is said to be "predetermined" and varies from 85% to 112% of the normal input rate. The term "reduced rate" as used herein indicates fuel supply at 85% of the normal input rate, and the term "increased rate" indicates fuel supply at 112% of the normal input rate.

Air supplied to the gas-fired construction heaters is another uncontrolled operating condition to which the more stringent ANSI Standard relates. Gas-fired construction heaters may have a blower that supplies fresh air to a heat exchanger which heats the air. The blower may also supply combustion air to the burner. Since gas-fired construction heaters are used at construction sites at which portable electric generators are used, the blowers are generally driven by an electric motor. Because such portable electric generators tend to output variable voltage, the ANSI Standard requires gas-fired construction heaters to operate in a range of from 85% to 110% of a standard supply voltage without exceeding the CO Standard. Thus, the gas-fired construction heaters must operate and meet the CO Standard in response to a range of such voltage that is said to be "predetermined" and varies from 102 VAC to 132 VAC if a standard supply voltage of 120 VAC is used. The term "reduced voltage" as used herein indicates that 85% of the standard supply voltage is supplied to the heater, and the term "increased voltage" means that 110% of the standard supply voltage is supplied to the heater.

Since the voltage is used by the heater to drive the blower, supply voltage variations result in changes in the pressure of the fresh air and the combustion air supplied by the blower. In this sense, there would be a "predetermined" range of pressure of such air corresponding to the predetermined range of the supply voltage.

Finally, the ANSI Standard requires the controls of gas-fired construction heaters to shut the burner off before the CO Standard or an upper temperature limit is violated. For example, the burner must shut off at the appropriate point as more and more area of the fresh air inlet and/or the heated air outlet is blocked. In testing such heaters, such blocking is done by successively placing pieces or strips of 1.5 inch wide adhesive tape across each inlet and/or outlet. This is referred to as the "strip method." Alternatively, one may use an iris-type orifice which symmetrically restricts air flow through such inlet or outlet.

The problem Applicants faced, and which the present invention solves, is the provision, in a gas-fired construction heater which keeps the heated fresh air separate from the products of combustion ("furnace-type"), of structure which enables the heater to meet the ANSI Standard, and especially the CO Standard. Prior patents and so-called salamander heaters (which mix the heated fresh air and the products of combustion—and which meet the CO Standard) of which Applicants are aware have not appreciated the problem of providing a furnace-type gas-fired construction heater which meets the ANSI Standard.

An example is Pelsue U.S. Pat. No. 4,108,143. Although this patent recognizes the goal (in a skid-mounted cable maintenance heater) of efficient use of BTUs, it does discussed, and no tertiary air is supplied to complete the combustion.

Morris U.S. Pat. No. 3,765,398 relates variations of external wind conditions to variations in air flow to a burner. Morris provides an air-flow responsive air valve that shuts an air inlet to the burner's air blower when a gust of wind is sensed.

Ito, et al U.S. Pat. No. 3,757,767 appreciates a "lifting" problem, where the flame lifts off the burner, but solves it by selecting the size of flame holes 35. Secondary air is supplied parallel to the flame from a chamber.

Weiss U.S. Pat. No. 3,747,586 shows a solution to a different problem, and the solution (a variable port to a pilot) is contrary to the ANSI Standard. Weiss also shows a variable shutter to control air to the burner, contrary to the ANSI Standard.

Mayo U.S. Pat. No. 2,561,934 uses an adjustable primary air damper and directs forced air via a tube onto a flame. This shows a lack of appreciation of the ANSI Standards problem.

Velie U.S. Pat. No. 4,848,313 has a goal of improving efficiency of combustion and getting mor BTU output/cubic inch of heater. Velie shows primary and secondary air inlets below a flame spreader that is above a burner.

Velie U.S. Pat. No. 4,651,711 has a main concern of providing a removable burner. Velie uses a flame spreader without air holes at the flame tips. The air inlet is only at one side of the flames and there is no heat exchanger.

Yagisawa U.S. Pat. No. 4,427,367 is directed to avoiding carbon build-up on a fuel nozzle. Air is fed in an annular flow around a plate and along a nozzle and through the plate via openings to prevent carbon build-up.

Jalics U.S. Pat. No. 4,221,557 has a primary goal of sensing improper combustion conditions at a main burner, and turning the main burner off before its flame extinguishes. Jalics uses a secondary burner which extinguishes just before the main flame starts to operate in an incomplete combustion mode. Jalics does not refer to the ANSI Standard, and does not appreciate the requirements thereof as shown by the use of a variable air scoop.

SUMMARY OF THE PRESENT INVENTION

The present invention solves the problem of providing a gas-fired construction heater which meets the ANSI Standard. Applicants' analysis indicates that in a furnace-type gas-fired construction heater the term "draft" may be used to denote the flow of air from a plenum to the burner in the combustion chamber, where such air flow results from the pressure drop across an air inlet that is between the plenum and the burner. Also, "natural draft" may be used to denote draft caused or induced by the pressure drop from (1) the flow of combustion products out of the combustion chamber (resulting from combustion) and (2) the static air pressure in the plenum. Finally, "forced draft" may be used to denote draft caused by the pressure drop resulting from the velocity of the air as it flows into the plenum and impinges on a wall of the combustion chamber which is provided with the air inlet. Since forced draft is dependent on air velocity, "blocking" of forced draft refers to diverting such flow of air or otherwise preventing such flow of air from impinging on or flowing through such air inlet. Applicants' analysis also indicates that there are three combustion zones in the furnace-type gas-fired construction heater (primary, secondary and tertiary).

With this in mind, according to the principles of the present invention forced draft to the primary and tertiary zones is fully blocked, forced drafts to the secondary zone are partially blocked, and selected amounts of natural drafts are provided to the combustion chamber via separate fixed-area air inlets for each of such combustion zones. Thus, there are natural drafts to the primary and tertiary zones, and combined forced and natural drafts to the secondary zone. A burner control is set with respect to air pressure at the entrance to the plenum and a selected heated air upper temperature limit. The heated air outlet has a selected fixed area.

In use, the heater of the present invention either (1) operates:
- (a) within the predetermined range of the input rate,
- (b) within the predetermined supply voltage range, and
- (c) with limited blockage of either the fresh air inlet or the heated air outlet while meeting the CO Standard and being below the upper temperature limit, or (2) stops operating because the burner is shut off before the upper temperature limit is exceeded or the combustion products fail to meet the CO Standard, which shut off occurs under uncontrolled conditions that cause:
- (a) the input rate or the supply voltage to be outside of their respective predetermined ranges, or
- (b) the upper temperature limit to be reached.

An object of the present invention is to provide a heater which meets a selected operating standard.

A further object of the present invention is to provide a gas-fired construction heater which meets the ANSI Standard.

A related object of the present invention is to provide a furnace-type gas-fired construction heater which meets the ANSI Standard.

Another object of the present invention is to provide separate combustion air inlets to each of three combustion zones in a gas-fired construction heater.

Still another object of the present invention is to provide selected forced and/or natural draft to each of three combustion air inlets to a gas-fired construction heater to render such heater able to operate in compliance with the ANSI Standard.

Yet another object of the present invention is to control the burner of the gas-fired construction heater so that the burner is shut off before the CO Standard is exceeded if any of the following should occur: (1) excessive blockage of the air inlet to, or of the heated air outlet from, the gas-fired construction heater; (2) voltage supplied to the heater is outside of its predetermined range, or (3) the input rate is outside of its predetermined range.

A still further object of the present invention is to identify steps for modifying a standard furnace-type gas-fired construction heater to render it capable of operating in compliance with the ANSI Standard.

With these and other objects in mind, the present invention solves such problem by providing a gas-fired construction heater which meets the ANSI Standard and operates to supply heated air separately from products of combustion. The products of combustion are permitted to contain no more than a specified percent of a selected chemical compound when uncontrolled heater operating conditions are within predetermined ranges. The uncontrolled operating conditions include variations in the input rate and variations in the voltage supplied to the heater. Since such voltage is applied to a blower that supplies fresh air to the heater, a resulting uncontrolled operating condition is the pressure of the fresh air supplied to a heat exchanger and to a plenum of the heater.

The heater includes a combustion chamber for producing the products of combustion, the chamber having primary and secondary combustion zones. A heat exchanger receives the products of combustion and transfers heat therefrom to fresh air to be heated. The combustion chamber and the heat exchanger define a tertiary combustion zone. Inlets supply a separate natural air draft to each of the primary and tertiary combustion zones. The inlets include a first and third fixed-area inlets for respectively supplying the separate natural drafts to the primary and tertiary combustion zones. Additional fixed-area inlets supply forced draft and natural draft to the secondary combustion zone. The fixed area of each of these inlets is selected so that the specified percent is not exceeded during operation of the heater when the uncontrolled variations of the input rate and the supply voltage (hence the fresh air pressure) are each within their respective predetermined ranges.

Another aspect of the present invention relates to modifying a standard gas-fired construction heater to meet the ANSI Standard. One such standard gas-fired construction heater has a plenum that receives forced draft which is unblocked and supplied to both a primary combustion zone and a secondary combustion zone of a combustion chamber. A variable air inlet in a first wall of the combustion chamber admits the forced draft to the primary zone, and no air inlet is provided directly to a tertiary combustion zone. A burner is also provided for supplying the gas. The gas is ignited in the combustion chamber and produces products of combustion. A closed duct has an inlet for receiving the combustion products and an exhaust outlet for discharging the combustion products. A housing guides air to be heated over the closed duct. The heated air is discharged from the housing. A blower supplies forced air to the housing and to the plenum. A pressure sensor monitors the pressure of the forced air from the blower and enables the burner to operate when the air pressure exceeds a relatively low limit (i.e., 0.2 inches of water). A thermal sensor responds to the temperature of the heated air and of the closed duct.

Such standard heater is modified according to the principles of the present invention by providing facilities for rendering the modified heater capable of operating without manual adjustment of the supply of the primary combustion forced draft. Such operation of the modified heater is in compliance with a selected standard, such as the ANSI Standard, which does not permit such manual adjustment, but which does limit the maximum percent of the given chemical compound (such as CO) which is permitted to exit the exhaust outlet when any of the following occur:

(1) the input rate varies in the predetermined input rate range, (2) the supply voltage varies in the predetermined supply voltage range, and (3) the forced air inlet or the heated air outlet become blocked, as is more fully discussed below.

The facilities include a baffle mounted close to the first wall of the combustion chamber for blocking the forced draft in the plenum so that only the natural draft enters the primary combustion zone of the combustion chamber and only partial forced draft enters the secondary combustion zone. Combustion air inlets, which may be provided in the first wall of the combustion chamber and/or in the closed duct, have separate fixed inlet areas. The primary air inlet is enlarged and admits the natural draft to the primary combustion chamber. Secondary air inlets are enlarged and partially covered by the baffle to admit both the forced draft and the natural draft to the secondary zone. Tertiary air inlets are provided for supplying the natural draft to the tertiary combustion zone. The secondary air inlets and the tertiary air inlets are provided in the first wall at a plurality of locations that are progressively further and further from the primary air inlet. The pressure sensor is set to open a first switch when the pressure of the forced air decreases below a specified pressure, which is the lowest fresh air pressure at which the maximum percent of the given chemical compound does not appear in the combustion products exiting the exhaust outlet. The thermal sensor is set to open a second switch in response to the temperature of the air in the closed duct and heat from the closed duct being at a maximum value. That value is selected to permit the input rate supplied to the burner to be at a maximum (as required by the selected standard) when the forced air pressure is at the lowest amount. A controller is responsive separately to the opening of the first switch or to the opening of the second switch for interrupting the operation of the burner. The interruption of the burner occurs as a result of either or both of the uncontrolled operating conditions being outside of the respective predetermined range or blockage of the fresh air inlet or the heated air outlet beyond a limit.

BRIEF DESCRIPTION OF THE DRAWINGS

Other objects, features and advantages of the present invention will be apparent from an examination of the following detailed descriptions which include the attached drawings in which.

GENERAL DESCRIPTION OF THE INVENTION

A heater 20 and a method of the present invention are described with respect to the ANSI Standard referred to above. The heater 20 is said to conform to the ANSI Standard, and testing of the heater 20 is described to illustrate compliance with the CO Standard.

Figure 1:
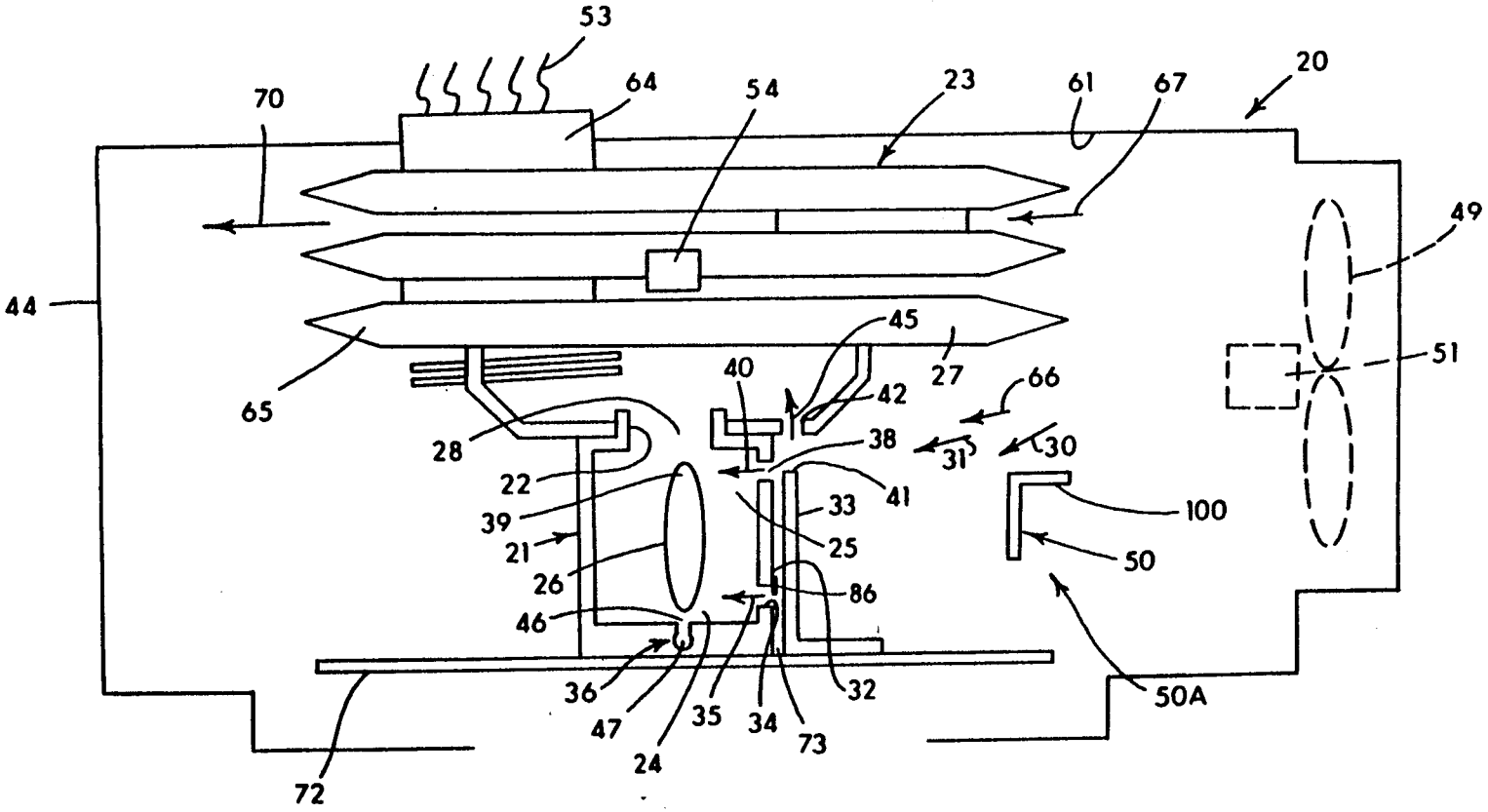
FIG. 1 is a schematic diagram of a gas-fired construction heater according to the present invention.

Referring to FIG. 1, the heater 20 is shown having a combustion chamber 21 connected to an exhaust inlet 22 of a heat exchanger 23. The volume of space in the combustion chamber 21 in which combustion initiates is referred to as a primary combustion zone 24. The primary combustion zone 24 extends to a secondary combustion zone 25 adjacent a plurality of spaced flames 26. From the secondary combustion zone 25 upward and within a closed duct 27 past the exhaust inlet 22 of the heat exchanger 23, there is a tertiary combustion zone 28. The combustion chamber 21 is mounted in a plenum 29 that receives forced combustion air (shown by arrow 30). The combustion air 30 flows in the plenum 29 toward a first wall 32 of the combustion chamber 21 (in the direction of arrow 31). A baffle 33 is provided in the plenum 29 closely adjacent to the first wall 32 to block the forced air 30 so it cannot flow directly to the wall 32 adjacent to a primary air inlet 34. The primary air inlet 34 has a fixed area and is formed in the first wall 32 behind the baffle 33 to supply natural primary combustion draft 35 to a burner 36 to support combustion in the primary combustion zone 24. This supports the flames 26, which extend upwardly through the secondary combustion zone 25 toward the exhaust inlet 22 to the closed duct 27 of the heat exchanger 23.

A series 37 (FIGS. 7 and 8) of secondary combustion air inlets 38 is provided in the wall 32 of the combustion chamber 21. Each secondary inlet 38 is located between adjacent ones of the flames 26 near tips 39 thereof. The secondary inlets 38 supply secondary combustion drafts (see arrow 40) to support combustion in the secondary zone 25. An upper edge 41 of the baffle 33 is vertically aligned with the center of the secondary inlets 38 so that the baffle 33 blocks half of the forced air 30 flowing to the secondary inlets 38. As a result, the secondary combustion draft 35 is both forced draft and natural draft.

Figure 6:
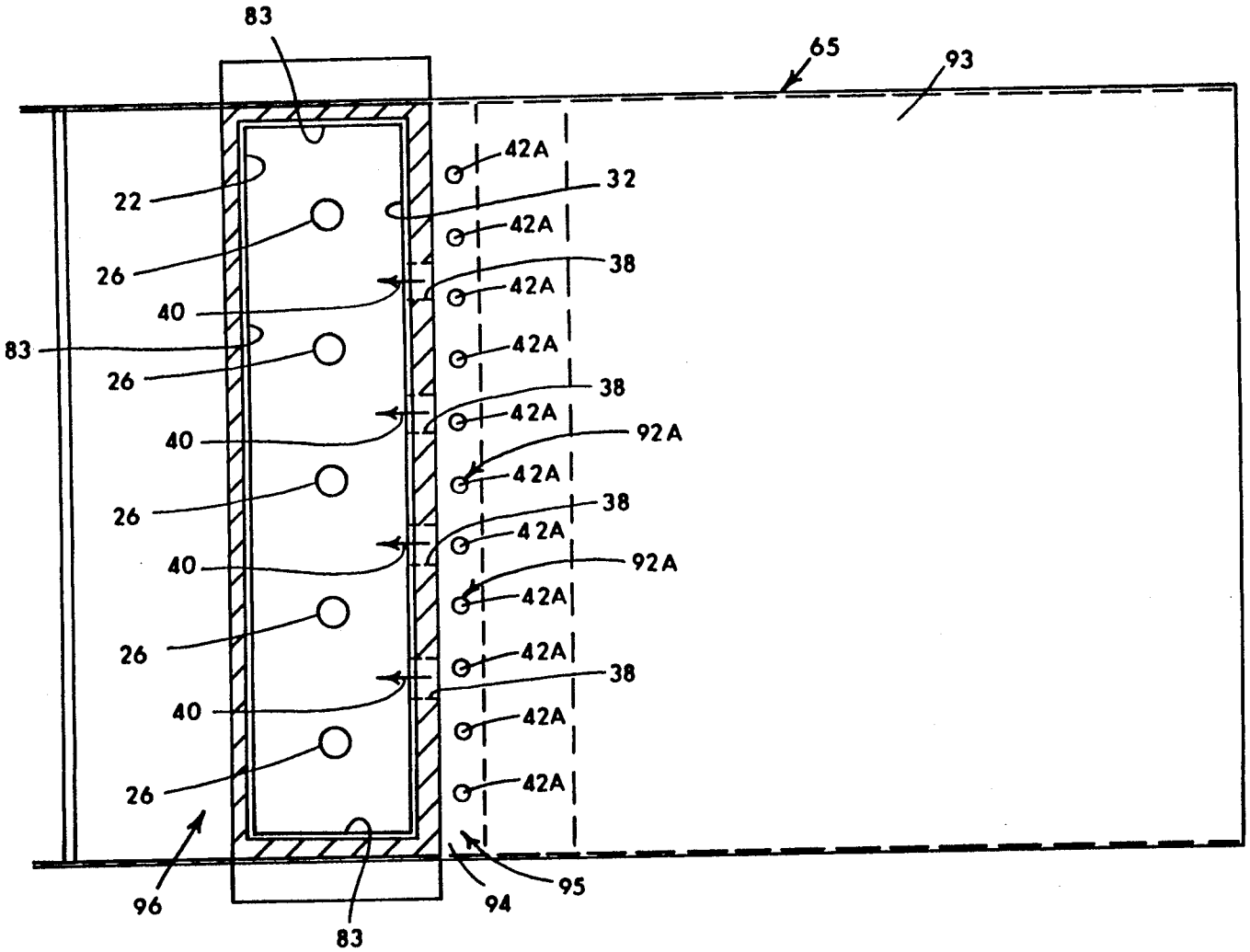
FIG. 6 is a cross sectional view taken on line 6—6 in FIG. 5 viewing upwardly to show a first embodiment of the tertiary air inlets.

The flames 26 extend upwardly from the secondary zone 25 to the tertiary combustion zone 28. Tertiary combustion air inlets 42, which are shown in detail in FIG. 6 provided in a wall 43 of the closed duct 27 of the heat exchanger 23, admit natural tertiary combustion draft (shown by arrow 45) to the closed duct 27 to support combustion therein. The heat exchanger 23 has a heated air outlet 44.

Fuel 46 is supplied to the combustion chamber 21 from a manifold 47. A manifold gauge 48 (FIG. 2) is shown for indicating manifold pressure, which is the pressure of the fuel 46 in the manifold 47.

A blower 49 is provided for causing the forced air 30 to flow in the plenum 29 and past the closed duct 27 to exit the heater 20 via the heated air outlet 44. A pressure sensor 50 indicates the pressure of the forced air 30 at an entrance 50A to the plenum 29. The blower 49 is driven by an electric motor 51. Voltage (see signal 52 in FIG. 3) supplied to the heater 20 may vary from a standard 120 VAC and drives the motor 51.

The areas of the respective primary, secondary, and tertiary inlets 34, 38 and 42 are selected to enable the heater 20 to meet the CO Standard even though:

(1) the input rate (generally indicated by the manifold gauge 48) varies within the above-described predetermined input rate range, and (2) the voltage 51 varies in the above-described predetermined supply voltage range.

Figure 13:
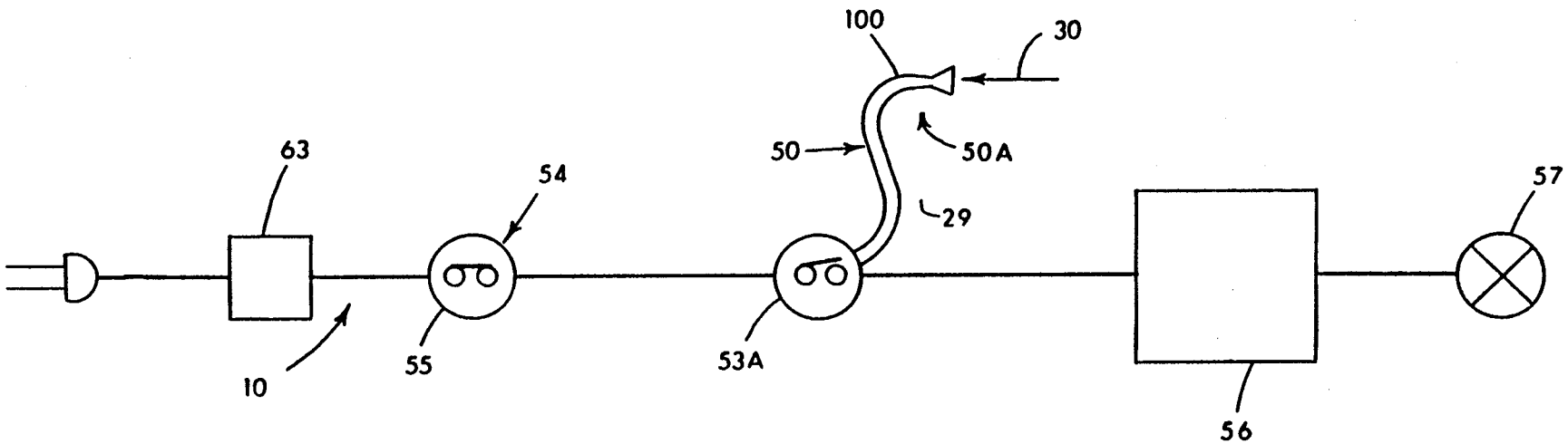
FIG. 13 is a diagram of a circuit for controlling a fuel valve.

To comply with the ANSI Standard, the burner 36 must shut off before products of combustion 53 exceed the limit set by the CO Standard for the chemical compound, such as CO. For this purpose the pressure sensor 50 is set to open a first or air pressure switch 53A (FIG. 13) when the air pressure at the entrance 50A to the plenum 29 decreases below a specified pressure. Also, a thermal sensor 54 responds to the temperature of the forced air 30 flowing past the closed duct 27 and to the temperature of the closed duct 27 of the heat exchanger 23. The thermal sensor 54 controls a normally closed switch 55 (FIG. 13) which opens when the temperature sensed indicates that the temperature of the closed duct 27 exceeds an upper temperature limit. In response to either or both the opening of the air pressure switch 53A or the opening of the thermal sensor switch 55, a burner control 56 (FIG. 13) closes a fuel valve 57 (FIG. 13) which stops the flow of the fuel 46 to the burner 36, rendering the burner 36 inoperative.

As modified, the heater 20 of the present invention either:

(1) operates
   a. within the predetermined input rate range,
   b. within the predetermined supply voltage range, and
   c. with limited blockage of either a fresh air inlet 58 or the heated air outlet 44, or (2) operates as in (1) until the occurrence of uncontrolled conditions that cause:
   a. the input rate or the supply voltage to be outside of their respective predetermined ranges, or
   b. the upper temperature limit to be reached, whereupon the heater 20 stops operating because the burner 36 is shut off before the combustion products 53 fail to meet the CO Standard.

DETAILED DESCRIPTION OF HEATER 20

Figure 2:
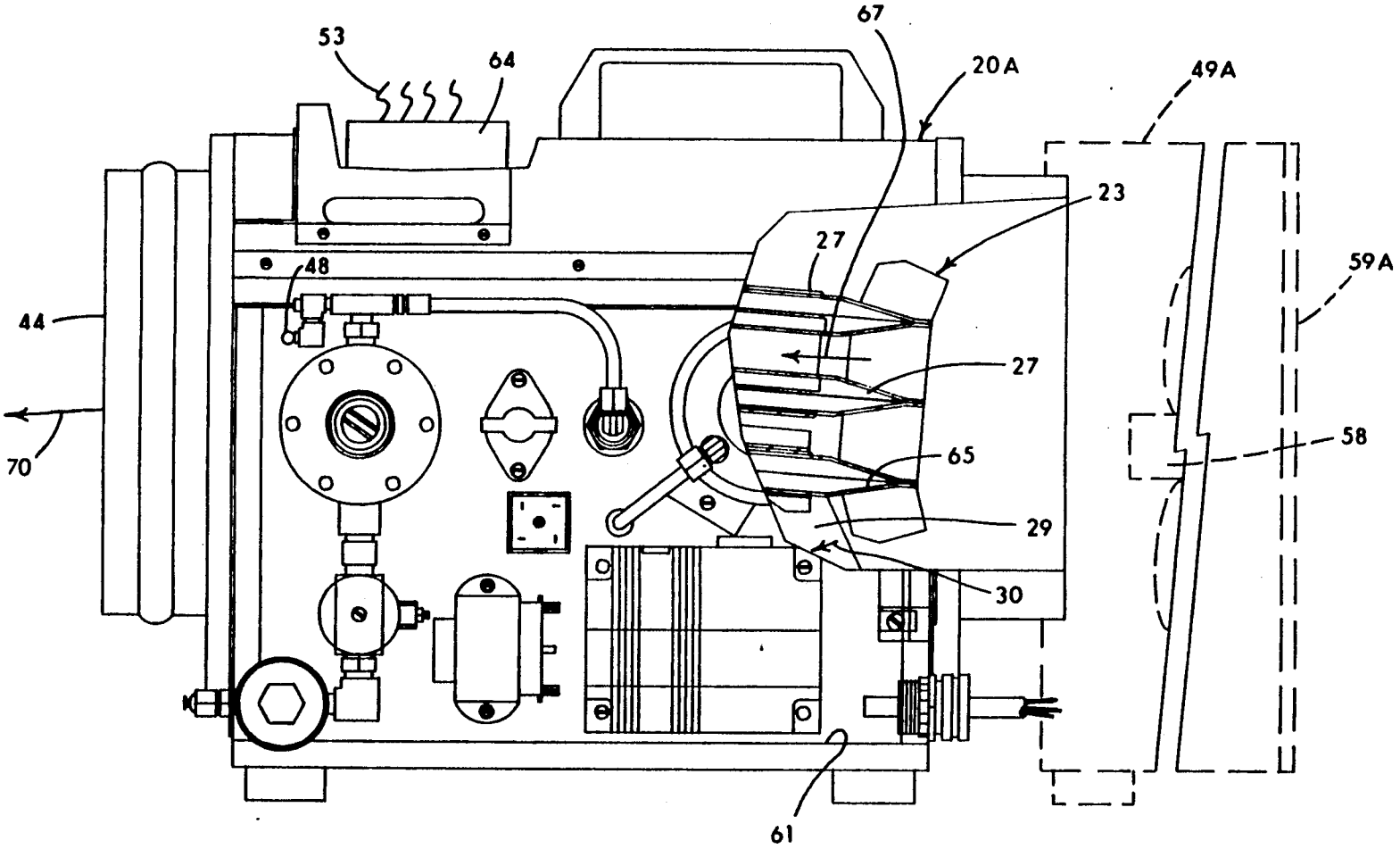
FIG. 2 is an elevational side view of the heater shown in FIG. 1 adapted to be attached to an auxiliary blower.
Figure 3:
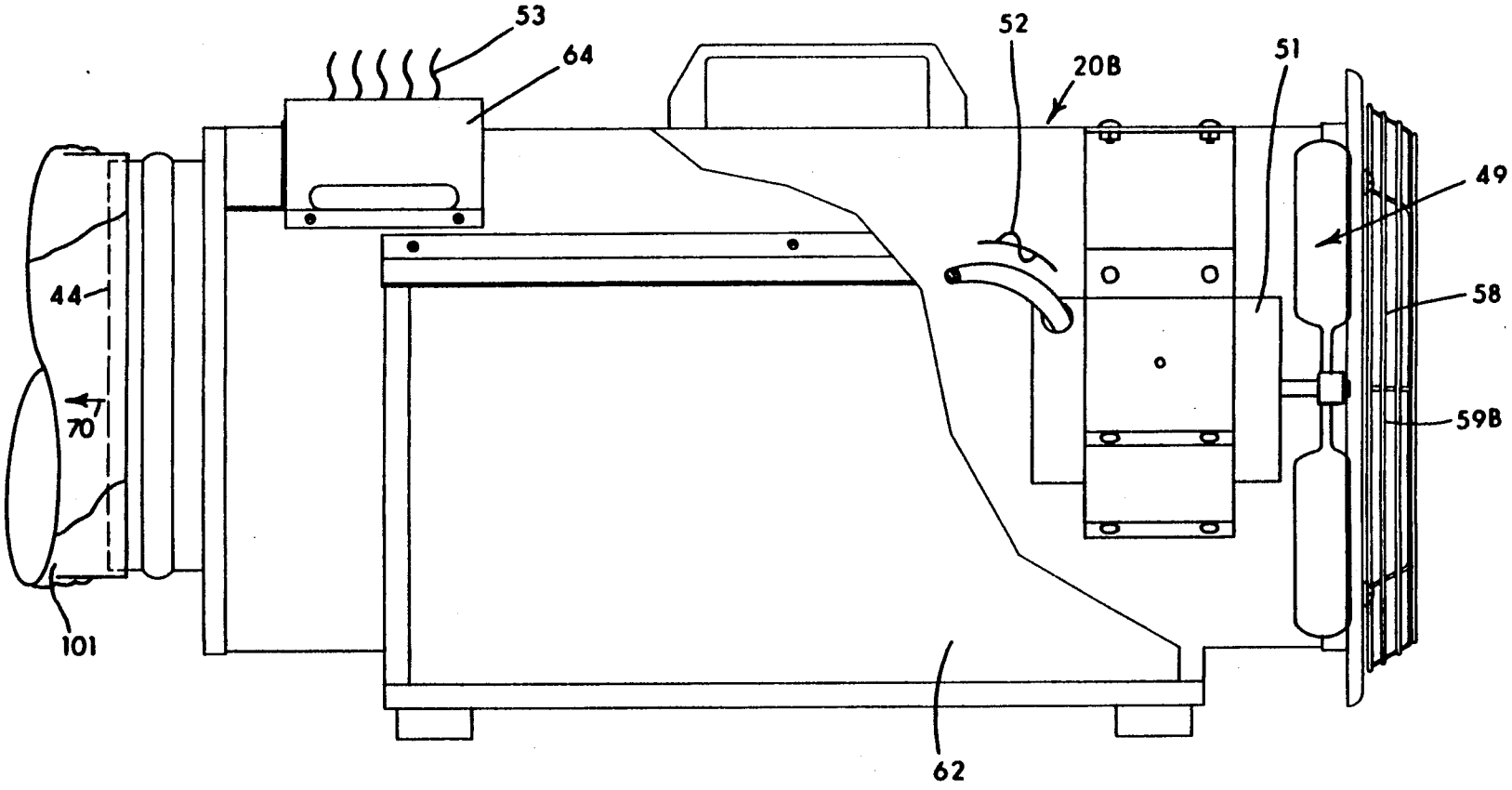
FIG. 3 is an elevational side view of the heater of FIG. 1 having a integral blower.

With the general description in mind, reference is made to FIGS. 2 and 3 which show two embodiments of the heater 20. Embodiment one, referred to using the reference 20A, is shown in FIG. 2 for use with an auxiliary blower 49A, such as the Model 1325B sold by the T. A. Pelsue Company. Embodiment two, referred to using the reference 20B, is shown in FIG. 3 as having the blower 49B integral with the heater 20B.

In each case, the heater 20A or 20B is supplied with the voltage 52 which may vary beyond the above-described predetermined range, which was described as being from 102 VAC to 132 VAC relative to the standard value of 120 VAC.

For purposes of describing the present invention, the heater 20A (FIG. 2) will be described, it being understood that the heater 20B (FIG. 3) is provided with structure and operation similar to that of the heater 20A, except for the integral nature of the blower 49B and as noted below. The blowers 49A and 49B are protected by a screen 58 and force the air 30 through a fresh air inlet 59A having a fixed area. A corresponding fresh air inlet 59B is shown in FIG. 3.

The fresh air inlet 59A may become blocked during use of the heater 20A, such as by a piece of paper being sucked against the screen 58. This is simulated in testing performed to determine compliance of the heater 20A with the ANSI Standard. In the test using the strip method, strips 60 of tape are successively placed on the screen 58 to partially block the fresh air inlet 59A.

Continuing to refer to FIGS. 1 and 2, a heater housing 61 contains the heat exchanger 23, the burner 36, the combustion chamber 21 and the plenum 29. The plenum 29 extends from the entrance 50A (on the right in FIG. 2) to the first wall 32 of the combustion chamber 21 (on the left in FIG. 1). A control unit 62 positioned outside the housing 61 houses the controller 56 and other standard items, such as an "on/off" switch 63 (FIG. 4).

Figure 4:
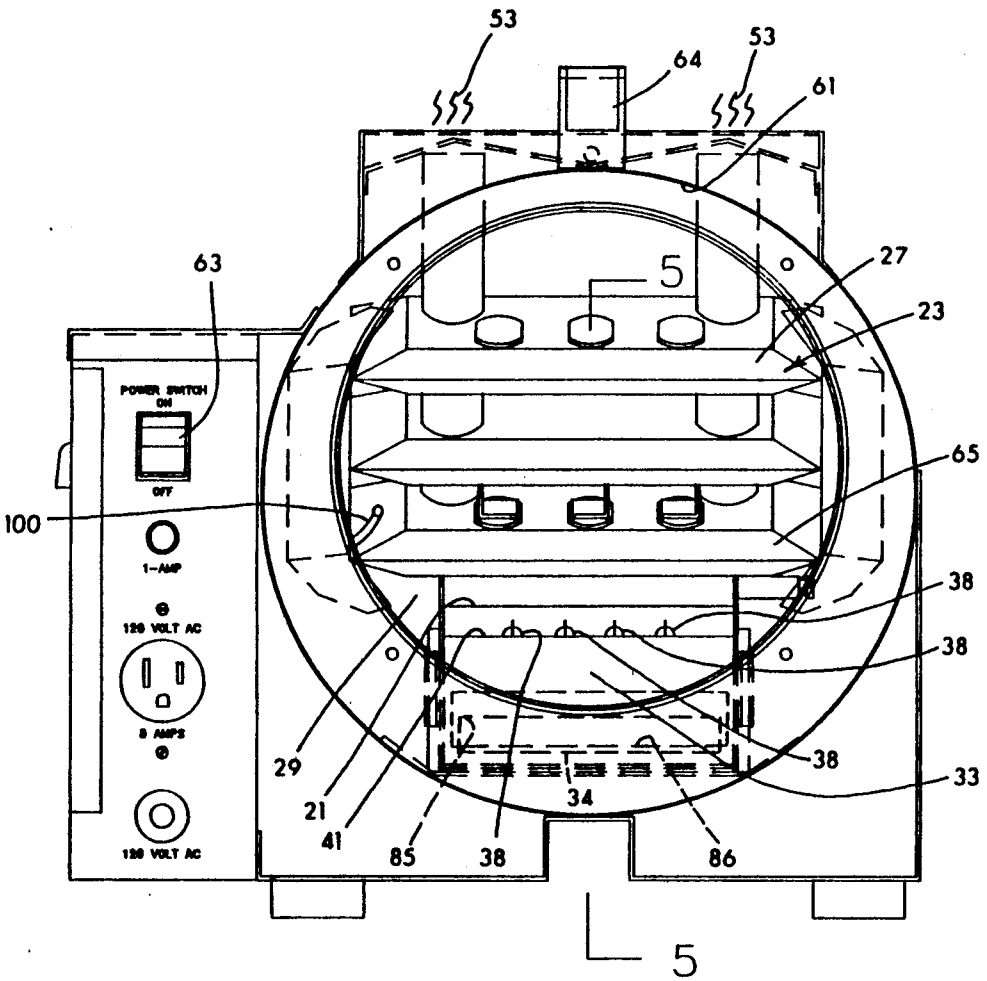
FIG. 4 is an elevational end view of the heater of the present invention showing a support plate for a combustion chamber and a heat exchanger.
Figure 5:
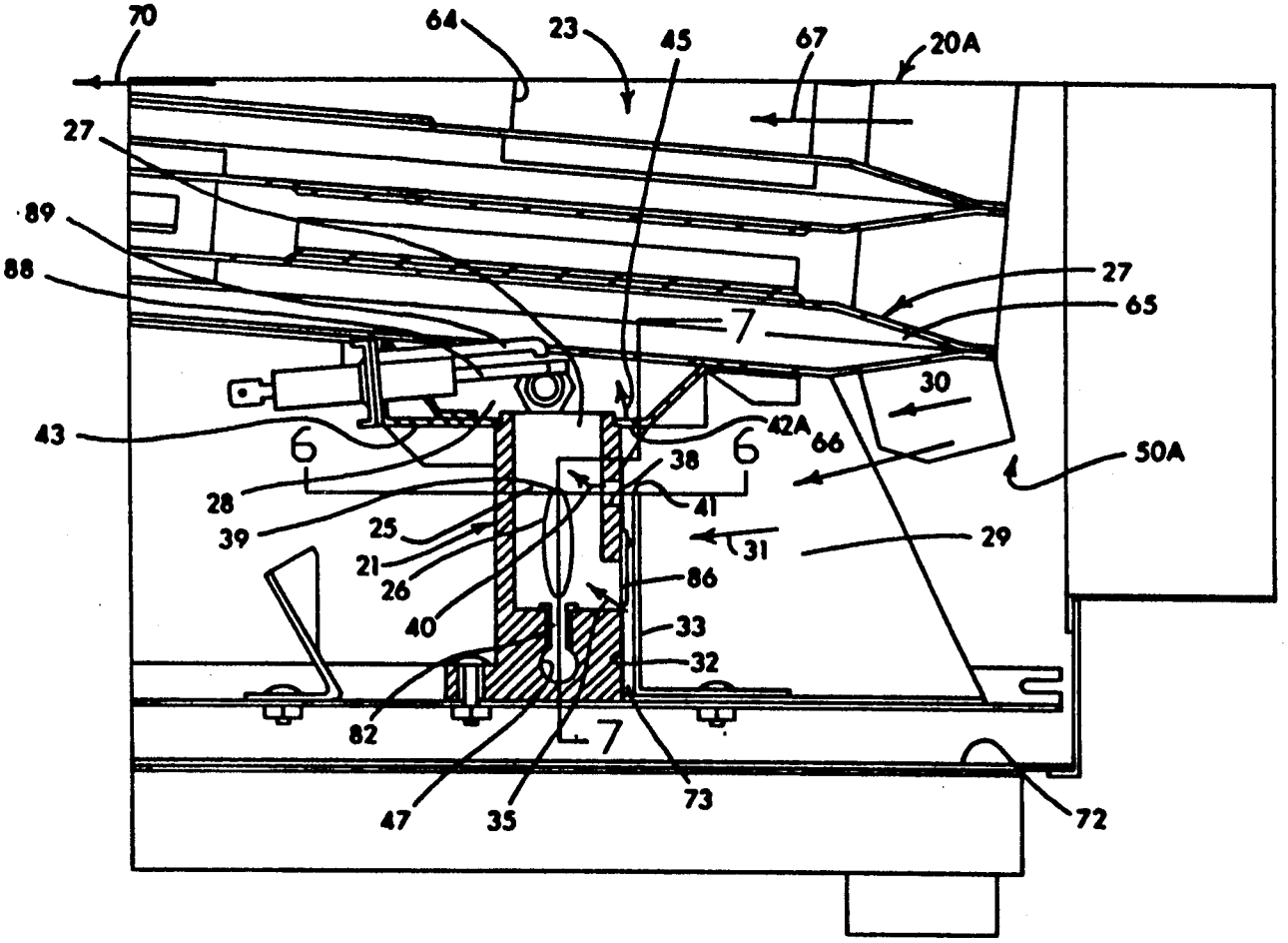
FIG. 5 is an enlarged cross sectional view taken along line 5—5 in FIG. 4 showing primary, secondary and tertiary combustion air inlets for supplying combustion air to respective primary, secondary and tertiary combustion zones.

Referring to FIGS. 4 and 5, the heat exchanger 23 of the heater 20A is shown in greater detail. The heat exchanger 23 may be fabricated from 304 stainless steel to permit it to operate at a high (e.g., 1200 ° F.) temperature. The closed duct 27 extends in a serpentine path from the inlet 22 to exhaust stacks 64 which extend through the housing 61. A lower section 65 of the closed duct 27 extends horizontally, front-to-back in the housing 61 and divides the forced air 30 into a combustion air flow path (see arrow 66) and a fresh air flow path (see arrow 67 in FIG. 1).

Figure 10:
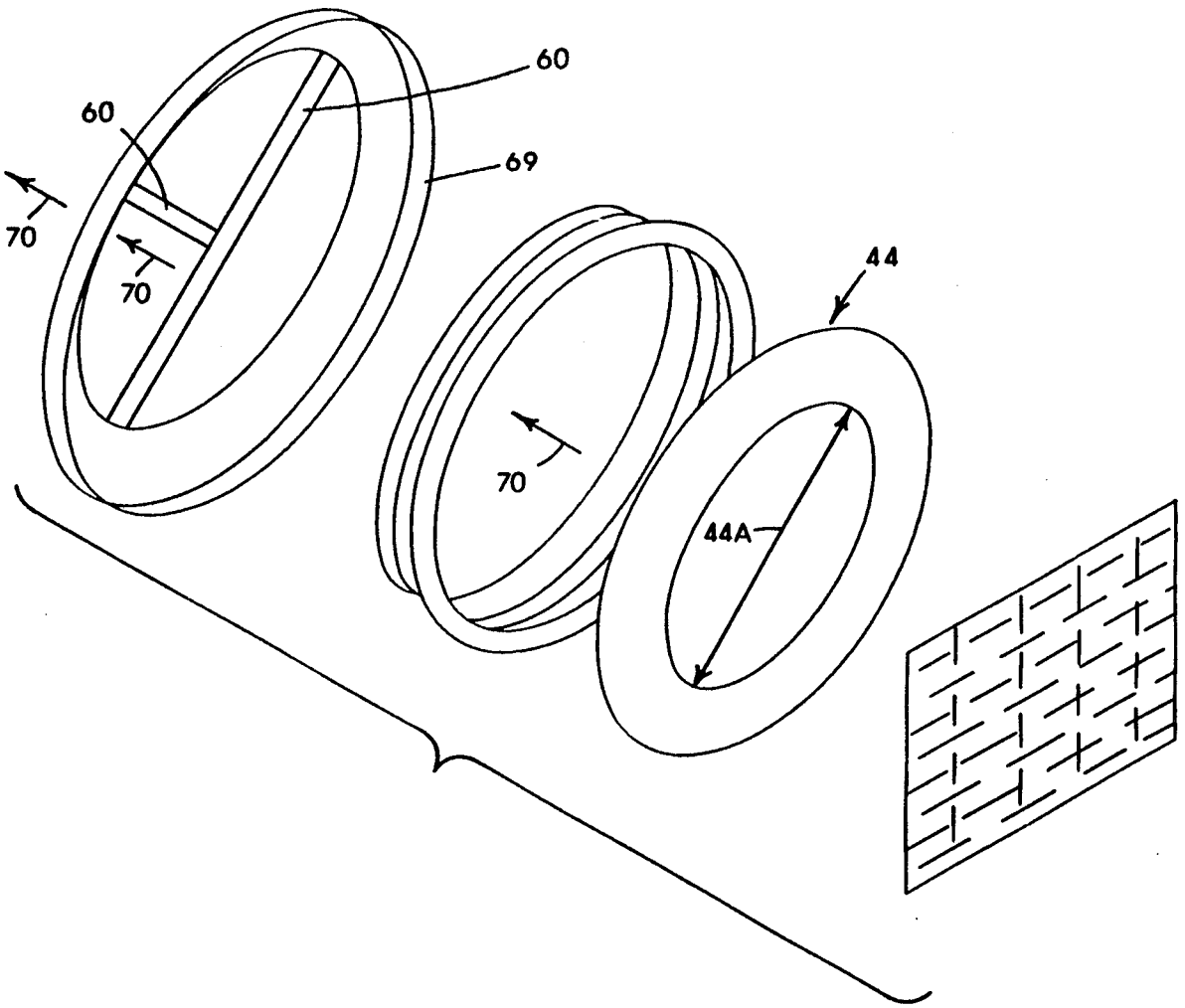
FIG. 10 is an exploded view of a heated air outlet of the heater.

The products of combustion 53 flow in and heat the closed duct 27. The heat is transferred to the air in the fresh air path 67, which exits the housing 61 through the heated air outlet 44. The outlet 44 is shown in FIG. 10 as having a circular shape, a diameter 44A, and has an area selected as described below. A screen 69 is placed over the outlet 44.

In the use of the heater 20, equipment (not shown) may be placed next to the outlet 44, or other items may block the flow of heated air (shown by arrow 70) from the housing 61. Similarly, a flexible duct 101 (FIG. 3) may be attached to the heated air outlet 44, and such duct 101 may become blocked. When either event occurs, the flow of the forced air 30 in the fresh air path (arrow 67) decreases and less heat is transferred from the closed duct 27. As a result, the temperature of the closed duct 27 increases and is sensed by the thermal sensor 54.

Figure 7:
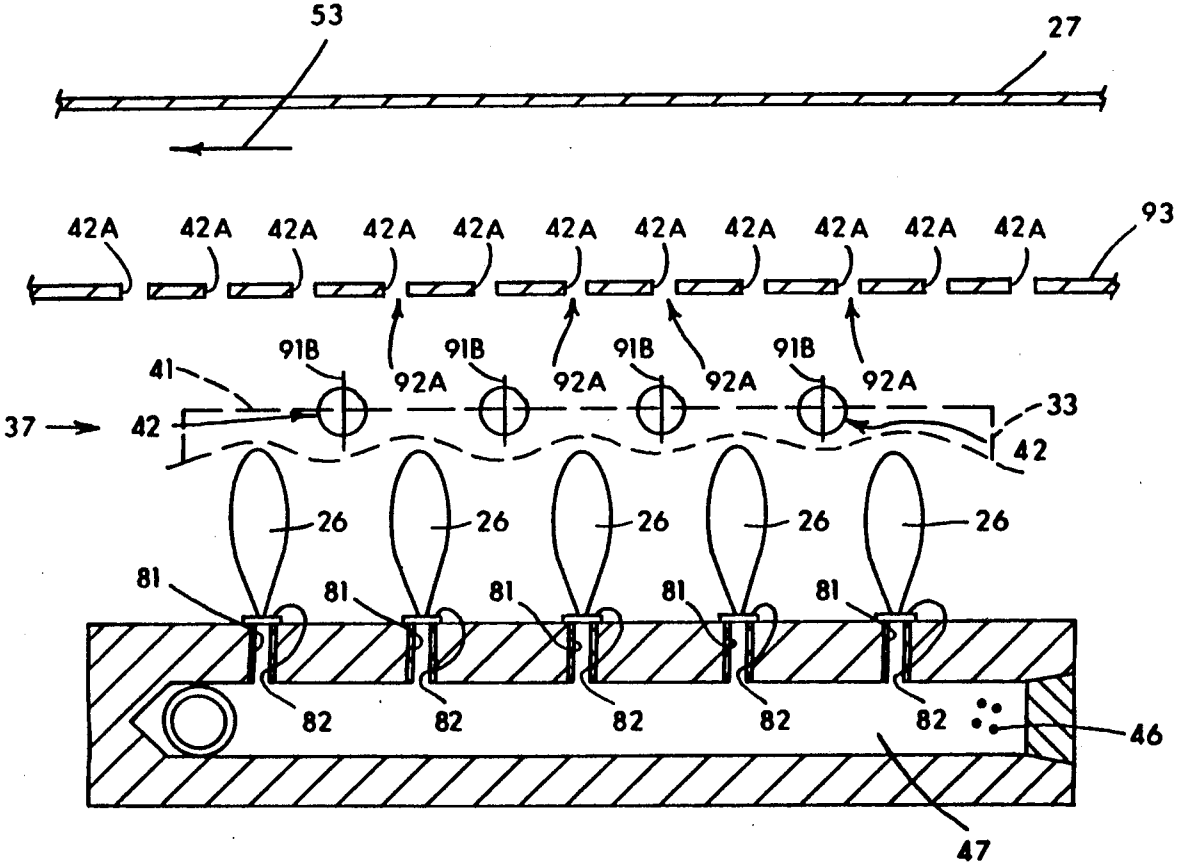
FIG. 7 is a cross sectional view taken along line 7—7 in FIG. 5 showing the location of the secondary air inlets relative to both the flames from a burner and to the tertiary inlets.
Figure 8:
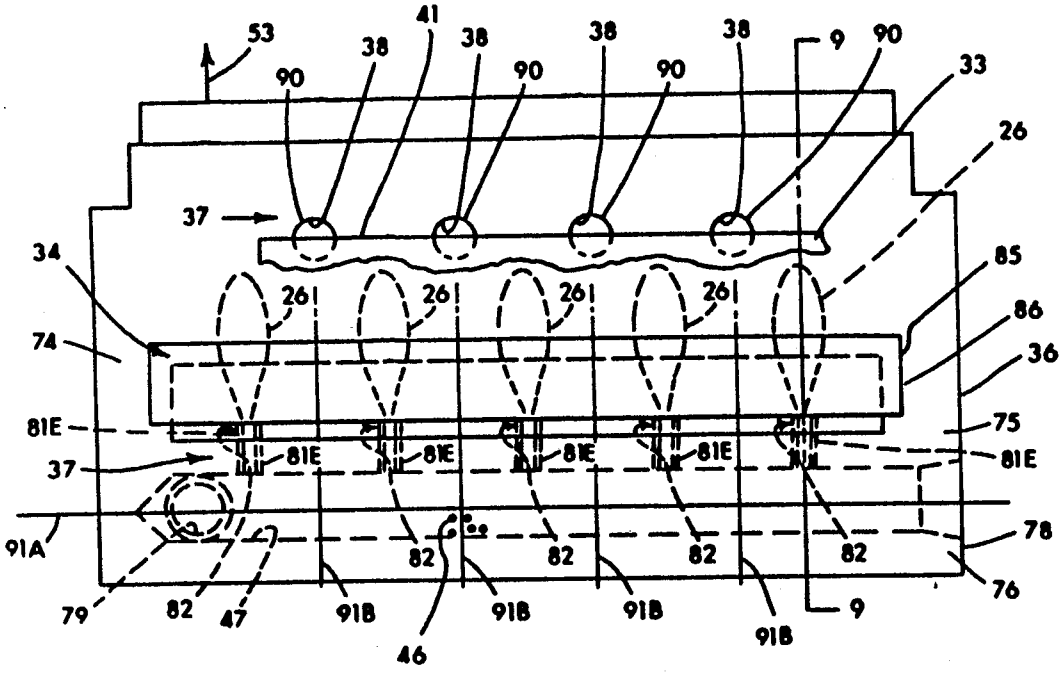
FIG. 8 is an enlarged view of the combustion chamber showing a burner formed therein for supplying fuel to be burned to produce hot products of combustion.

Considering FIG. 5, 7, 8 and 9, the combustion air flow path 66 extends in the direction of the arrow 31 under the lower section 65 within the plenum 29 of the housing 61. The forced air 30 is thus directed toward the first wall 32 of the combustion chamber 21. A base 72 secured to the housing 61 supports the combustion chamber 21 and the baffle 33. The baffle 33 has an L-shape and is fixed to the base 72 to provide a space 73 between the first wall 32 and the baffle 33. The baffle 33 extends horizontally (FIGS. 7 and 8) across the wall 32 from a left side 74 (FIG. 8) to a right side 75 and covers the primary combustion air inlet 34. In this manner, none of the forced air 30 enters the primary inlet 34. Rather, according to the static air pressure in the plenum 29, the natural draft 35 flows into the primary air inlet 34. The upper edge 41 of the baffle 33 is shown in FIG. 8 extending horizontally in alignment with the centers of the secondary inlets 38.

Figure 9:
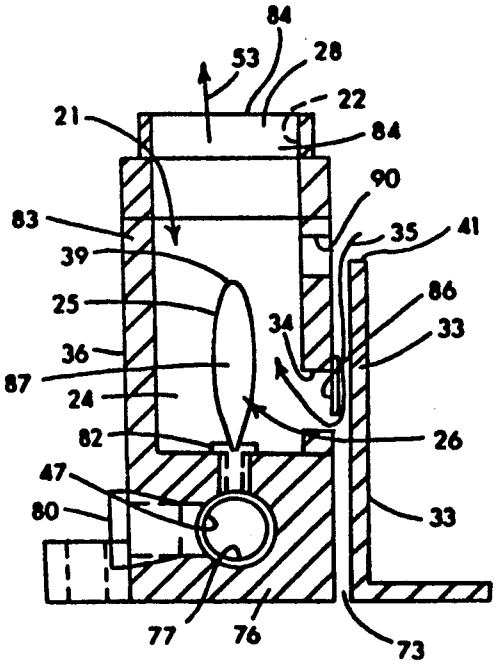
FIG. 9 is an end view of the combustion chamber.

Referring now to FIGS. 8 and 9, the burner 36 and the combustion chamber 21 are shown fabricated from a casting 76. The burner 36 includes a bore 77 extending from one end 78. The end 78 is plugged after drilling the bore 77. The bore 77 intersects a transverse bore 79 that is tapped to receive a fuel supply fitting 80. The fitting 80 is connected via standard fuel supply components 80A (FIG. 2) to the fuel valve 57 (FIG. 13) and to a fuel tank (not shown). The bore 77 forms the manifold 47. The pressure (manifold pressure) of the fuel 46 in the manifold 47 may be indicated by the fuel pressure gauge 48 (FIG. 2) which may be connected to a gauge port 80B (FIG. 2). Fuel supply holes 81 are drilled in the casting 76 at spaced locations at which it is desired to position the flames 26. A fuel orifice 82 (e.g., a fixed gas orifice) of a selected size, such as #59, is received in each hole 81 to regulate the amount of fuel 46 supplied to the combustion chamber 21. The fuel orifice 82 is selected according to the particular fuel 46 that is to be burned. For example, gas vapor fuels such as butane, compressed natural gas or propane may be burned.

The combustion chamber 21 is formed by the first wall 32 and by walls 83 of the casting 76. A top 84 of the casting 76 is open to allow the products of combustion 53 to flow into the exhaust inlet 22 of the heat exchanger 23. The primary combustion air inlet 34 includes an elongated opening 85 cast through the first wall 32 and extending horizontally past each of the end fuel supply holes 81E. The inlet 34 also includes a shutter 86 that is wider and longer than the opening 85 and that covers a selected portion of the opening 85. The shutter 86 is fixed to the casting 76 so that the area of the primary combustion air inlet 34 is fixed at a selected value as discussed below. The primary air inlet 34 is vertically aligned with and extends across the bases 87 of the flames 26 to provide the primary natural draft 35 to the primary combustion zone 24 at the lower portion of the combustion chamber 21.

With the fuel 46 supplied to the orifices 82 and the primary draft 35 supplied from the inlet 34, an igniter 88 is effective to ignite the air-fuel mixture to form the flames 26. When a flame sensor 89 (FIG. 5) senses the flames 26, it causes the controller 56 (FIG. 13) to keep the valve 57 open, whereas when the flames 26 are out, the sensor 89 causes the controller 56 to shut the valve 57.

The flames 26 also require the secondary combustion drafts 40 for proper combustion that meets the CO Standard. For this purpose, the secondary combustion air inlets 38 are provided in the form of horizontal holes 90 (FIG. 9) drilled through the first wall 32 to which the shutter 86 is attached. The area of each hole 90 is as described below, and is a fixed area. The holes 90 are spaced horizontally and are parallel to the longitudinal axis 91A of the opening 85. Each hole 90 is centered along a line 91B extending vertically and bisecting the space between the holes 81. The upper edge 41 of the baffle 33 is vertically aligned with the center of the holes 90. In this manner, the baffle 33 blocks half of the forced draft 30 flowing toward the holes 90, such that a reduced flow of the forced air 30 is permitted to flow over the upper edge 41 and through the holes 90 as the drafts 40. As a result, the secondary combustion drafts 40 include reduced flow of forced air 30 and the natural draft, which are supplied through the holes 90 into the secondary combustion zone 25.

The tertiary combustion zone 28 extends from just above the secondary air inlets 38 vertically through the exhaust inlet 22 into the lower section 65 of the closed duct 27 of the heat exchanger 23. It may be observed in FIG. 1 that the secondary air inlets 38 and the tertiary air inlets 42 are located progressively further and further from the primary combustion air inlet 34. There are three embodiments of the tertiary combustion air inlets 42.

FIRST EMBODIMENT OF TERTIARY COMBUSTION AIR INLETS 42

Referring to FIGS. 5, 6 and 7, the first embodiment of the tertiary air inlets 42 is shown and these inlets are referred to as inlets 42A. The inlets 42A are in the form of many circular ports 92A (FIG. 7) in a bottom 93 of the lower section 65, shown as the wall 43 in FIG. 5. The ports 92A are in a row as shown in FIG. 6, and are adjacent to an edge 94 of the exhaust inlet 22. The bottom 93 is parallel to the direction 31 of the forced air 30 such that there is no effective dynamic air pressure on the ports 92A. As a result the natural draft 45 enters the ports 92A to provide the tertiary combustion air to the tertiary combustion zone 28. The ports 92A are shown in FIG. 6 on an upstream side 95 of the exhaust inlet 22, but may be located on a downstream side 96 of the inlet 22. The number and size of the ports 92A are as described below.

SECOND EMBODIMENT OF TERTIARY COMBUSTION AIR INLETS 42

Figure 12A:
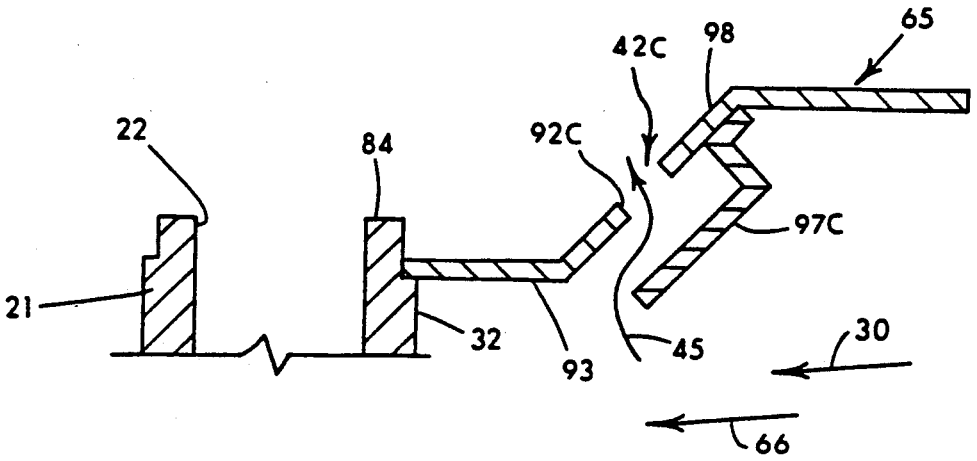
FIGS. 12A and 12B describe two alternate embodiments of the combustion chamber and the heat exchanger of the present invention, wherein the tertiary inlets are provided at different locations, but in the same relationship to the secondary air inlets.
Figure 12B:
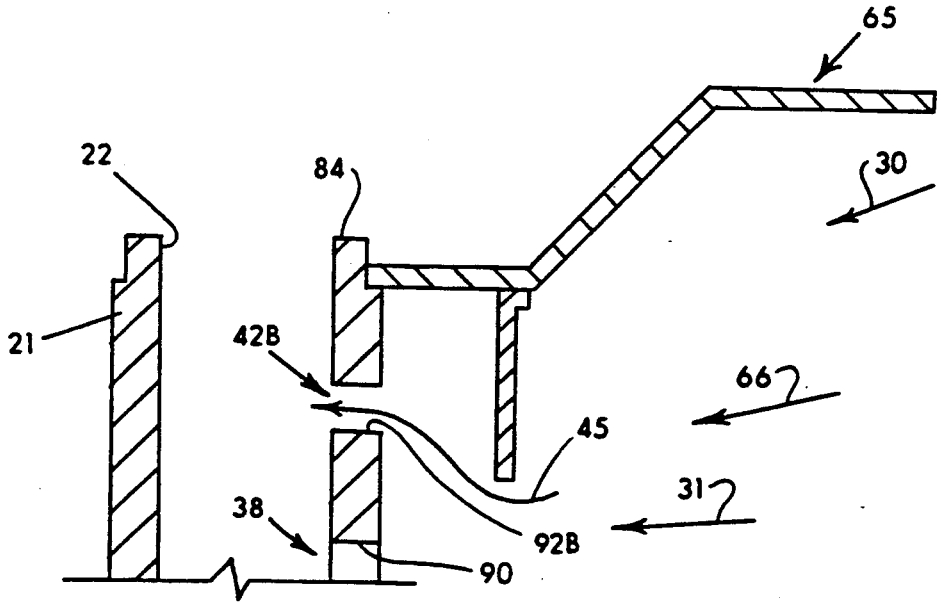

The second embodiment of the tertiary combustion air inlets 42 is shown in FIG. 12B. These inlets are referred to as inlets 42B and are provided as ports 92B formed in the first (front or right) wall 32 of the combustion chamber 21. The ports 92B serve the same function as the ports 92A, and are located adjacent to the exhaust inlet 22. Because the ports 92B are in the flow of the forced draft 30, a tertiary baffle 97B is secured to the wall 32 over the ports 92B and spaced from the bottom 93 for blocking the forced air 30, but allowing the natural draft 45 to enter the ports 92B.

THIRD EMBODIMENT OF TERTIARY COMBUSTION AIR INLETS 42

The third embodiment of the inlets 42 is shown in FIG. 12C. These inlets are referred to as inlets 42C and serve the same function as the inlets 42A. The inlets 42C are in the form of ports 92C extending through an inclined section 98 of the bottom 93 of the lower section 65. The ports 92C are spaced further from the inlet 22 than the ports 92B, but are higher relative to the inlet 22. Because the ports 92C are in the flow of the forced air 30, an inclined, tertiary baffle 97C is secured to the inclined section 98 closely spaced relative thereto for blocking the forced air 30, but allowing the natural draft 45 to enter the ports 92C.

DESCRIPTION OF METHOD OF MODIFICATION OF STANDARD HEATER TO FORM THE HEATER 20

Figure 11A:
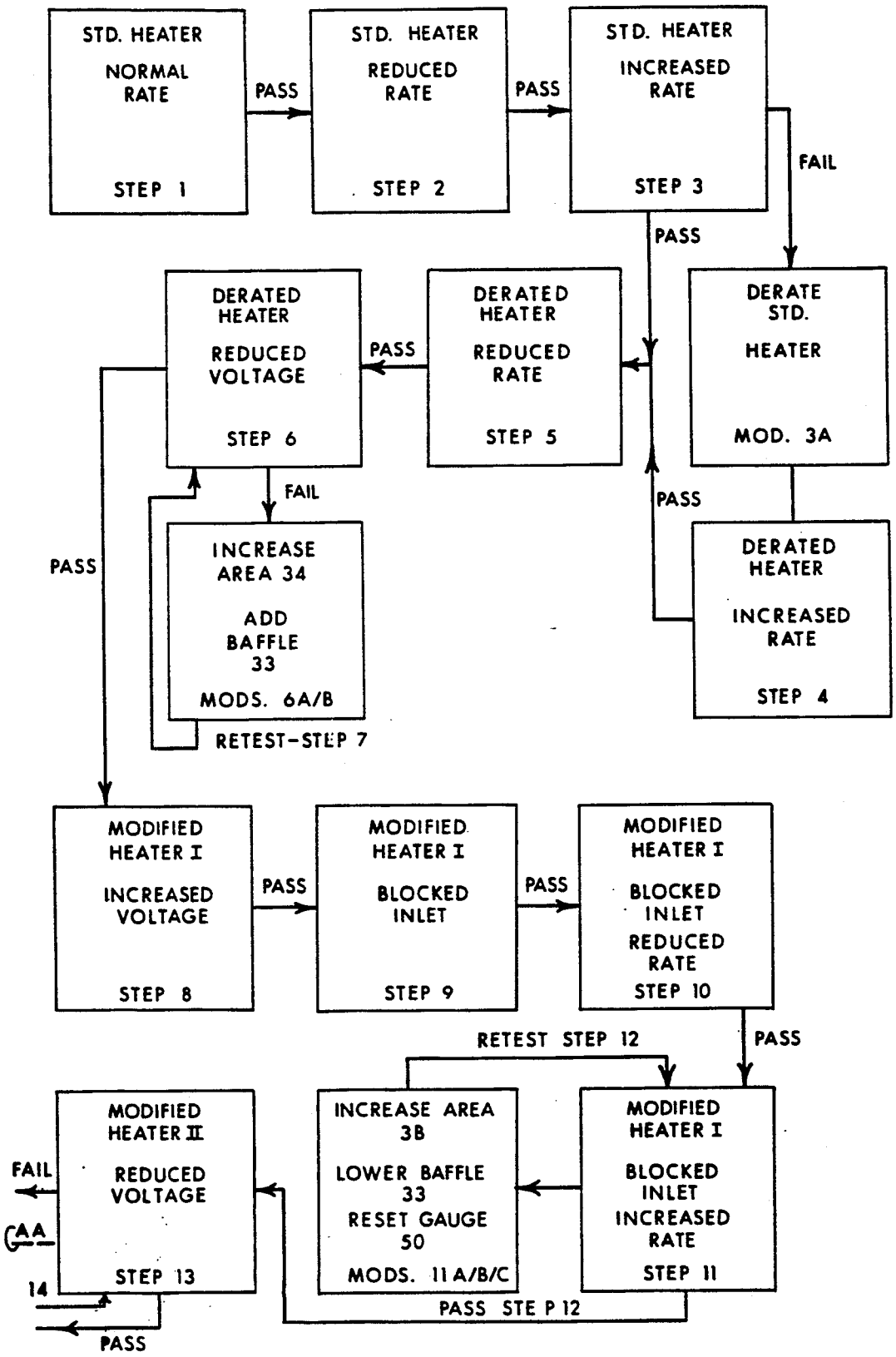
FIGS. 11A-11C, when joined along lines AA and BB, form a flow chart describing the method of the present invention by which a standard heater is converted to a heater of the present invention.
Figure 11B:
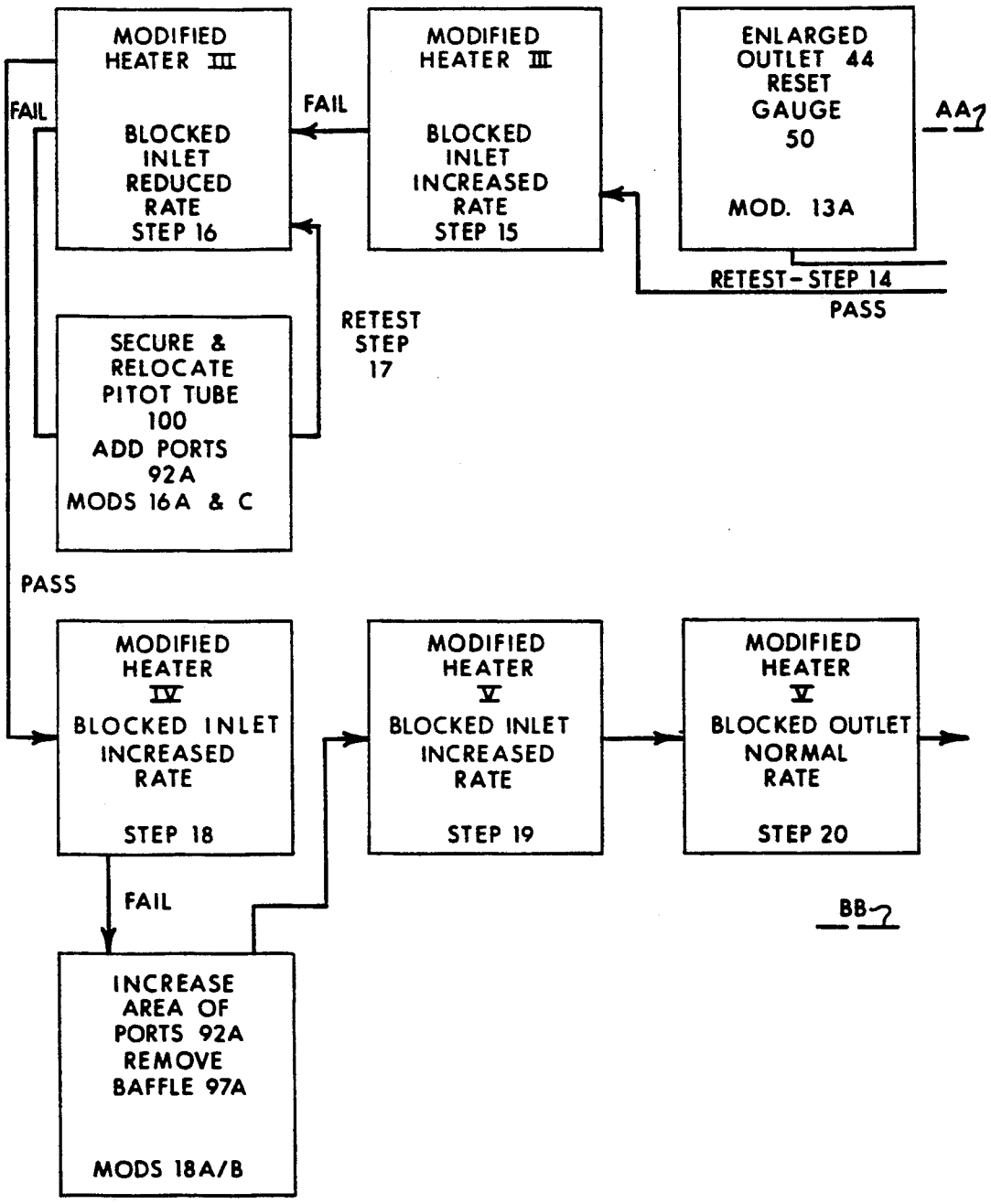
Figure 11C:
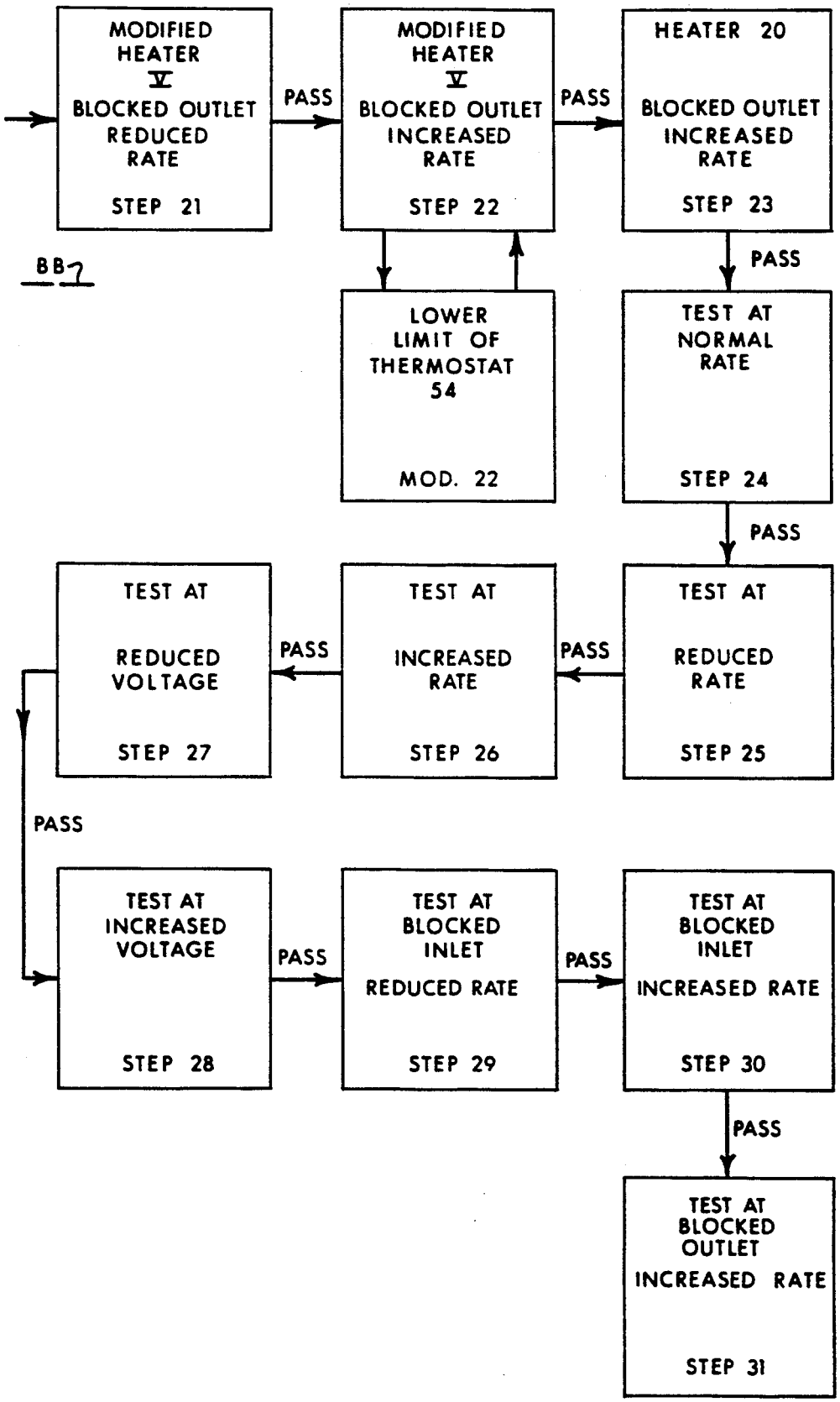

As an example of how a standard gas-fired construction heater may be modified to provide the heater 20 of the present invention, reference is made to FIGS. 11A–11C. The standard heater may be a Model 1690 heater sold by the T. A. Pelsue Company. As described above, the Model 1690 is used with an auxiliary blower 49A, which may be a Model 1325B sold by the T. A. Pelsue Company. In describing the modifications to the Model 1690, reference is made to the corresponding structural elements of the heater 20, because, as modified according to all of the Steps 1–31 in which modifications were made, the Model 1690 became the heater 20.

The standard heater is rated at 52,000 BTU and burns 20.8 cubic feet of propane fuel 46 per hour. The burner orifices of the Model 1690 are #56 and are used with a standard manifold pressure of ten inches of water at normal input rate. The blower 49 of the Model 1325B operates at a standard voltage of 115 VAC. The area of the primary combustion air inlet 34 is 0.3066 square inches (4.38 by 0.070 inches), and forced air 30 is applied directly against the combustion chamber wall that corresponds to the first wall 32 of the heater 20. Further, a manually variable damper is provided in the form of a shutter (not shown) which is adjustably mounted on the first wall 32 partially over the opening 85, which shutter is referred to as the shutter 86M to distinguish it from the fixed shutter 86 of the present invention. The standard model 1690 gas-fired construction heater has the characteristics identified in Chart 1 below.

CHART 1

| Model 1690 with Model 1325B | |
|---|---|
| Area of primary combustion air inlet 34 (variable) (sq. in.) | nominally 0.3066 (0.07 in. × 4.38) |
| Area of secondary conbustion air inlets 38 (sq. in.) | 0.196 (4 holes @ .25 dia. each) |
| Area of tertiary combustion air inlets (sq. in.) | Zero |
| Upper temperature limit (°F.) read by thermal sensor 54 | 190 |
| Baffle covers primary inlet 34 | None |
| Baffle covers ½ of secondary inlets 38 | None |
| Normal supply voltage 52 to heater 20 (VAC) | 115 |
| Nominal air pressure (entrance 50A to plenum 29 - inches of water) | 0.6 |
| Area of heated air outlet 44 (square inches) | 18.19 |
| Rating of heater (BTU) | 52,000 |
| Burner orifice size and (number of orifices) | #56 (5) |
| CO in combustion products emitted from exhaust stacks 64 at normal conditions (115 VAC, normal input rate, normal voltage 52, no blockage of fresh air inlet | Less than 0.08% CO air-free |

CHART 1-continued

| Model 1690 with Model 1325B | |
|---|---|
| 59 or heated air outlet 44). | |
| Manifold pressure at normal input rate (inches of water) | 10 |
| Compliance with CO Standard | None |
| Air pressure at which pressure sensor 50 closes switch 53A (inches of water) | 0.2 |

By following the steps set forth in FIGS. 11A-11A and as described below, the operation of the Model 1690 (with the Model 1325B) was rendered in compliance with the CO Standard of the ANSI Standard. The following description not only indicates (1) the steps taken by Applicants to tests the Model 1690 to determine how the Model 1690 fails to meet the ANSI Standard, particularly the CO Standard, but (2) once a testing step is shown to not meet the CO Standard, indicates how the Model 1690 was modified to pass each particular test step.

Testing Per CO Standard—Modifying Model 1690

Step 1—Test at normal input rate

Test Result: pass

Step 2—Test at reduced rate

Test Result: pass

Step 3—Test at increased rate

Test Result: fail

Modifications

3A—Derate from 52,000 BTU to 45,000 BTU.

The action taken to pass this step was to derate the Model 1690 from 52,000 BTU to 45,000 BTU. This was based on a nominal heat value of 2,500 BTU per cubic foot of propane fuel 46 burned by the standard heater at normal conditions. Under test conditions, the actual heat value was 2,380 BTU per cubic foot. This was equivalent to 20.8 cubic feet of propane fuel 46 burned per hour.

The derating to 45,000 BTU was achieved by changing to a number 59 orifice (corresponding to the orifices 82 of the heater 20) in all of the burner distributor holes 81 of the heater 20. The Model 1690 is now referred to as the derated heater (FIG. 11A).

Step 4—Test at increased rate

Test Result: pass

With the number 59 orifices in the derated heater, the testing at increased rate met the CO Standard.

Step 5—Test at reduced rate

Test Result: pass

With the number 59 orifices in the Model 1690, the CO Standard was met during a rerun of step 2, (testing at reduced rate).

Step 6—Test at reduced voltage

Initial Test Result: fail

The standard supply voltage 52 was increased to 120 VAC, and in step 6 it was varied from the new nominal 120 VAC to 85% of nominal, or 102 VAC. Variation of this voltage 52 supplied to the derated heater resulted in variation of the number of cubic feet of fresh air flowing into the fresh air inlet 59A (FIG. 2). The failure to pass the CO Standard in this step indicated to Applicants that too little combustion air was supplied at reduced voltage.

Modifications

6A—increase area of primary air inlet 34.

6B—add baffle 33.

6C—reduce area of primary air inlet 34.

Modification 6A retained the overall size of the opening 85 in the casting 76, but adjusted the shutter 86M which, for testing, was adjustable. The adjustment provided a width of 0.1 inch for the primary combustion air inlet 34, compared to the original width of 0.070 inches. A trial test was conducted at reduced voltage, and the CO Standard was met. A trial test was then conducted at increased voltage (132 VAC) and the CO Standard was not met.

Modification 6B positioned the baffle 33 at 0.14 inches from the wall 32 and covering the primary air inlet 34. This blocked the flow of the forced air 30 to the primary air inlet 34, allowing the natural draft 35 to flow through the primary air inlet 34. The baffle 33 was positioned with the upper edge 41 blocking two-thirds of the secondary air inlets 38. The baffle 33 blocked most of the forced air 30 flowing toward the secondary combustion air inlets 38. This position of the baffle 33 allowed some of the forced drafts 40, but primarily the natural drafts 40, to enter the secondary combustion air inlets 38. During trial tests, the CO Standard was met at reduced voltage.

Modification 6C reduced the area of the primary combustion air inlet 34 by moving the shutter 86M to reduce the effective width of the opening 85 to 0.055 inches, and the CO Standard was met.

Step 7—Test at reduced voltage

Test Result: pass

With the modification made in step 3 and with modifications 6B and 6C, the Model 1690 heater is referred to in FIG. 11A as the Modified Heater I. Upon retest in Step 7, the Modified Heater I met the CO Standard.

Step 8—Test at increased voltage

Test Result: pass

The increased voltage 52 was 110% of the new nominal or standard 120 VAC, or 132 VAC. Notwithstanding the more stringent ANSI Standard, which does not permit manual adjustment of the primary air inlet 34, the modifications embodied in Modified Heather I were effective to enable the Modified Heater I to meet the CO Standard during the test in Step 8. For example, the ANSI Standard only allows use of fixed area primary air inlets, which Applicants achieve by using the fixed shutter 86.

Step 9—Test at blocked inlet—normal input rate

Test Result: pass

"Blocked inlet" refers to sequentially decreasing the effective area of the fresh air inlet 59 of the Model 1690. If the strip method is used, this is done by applying one 1.5 inch wide strip 60 of tape across the screen 58 and conducting the test (see FIG. 10 where strips 60 are placed over the outlet 44). If the CO Standard is met, another strip 60 or part of a strip 60 of tape is applied and the heater must either meet the CO Standard and continue operating, or before the CO Standard is not met must shut down by turning the burner 36 off. The test in Step 9 was passed using one and one-half strips 60. The strips 60 were arranged with one strip 60 across the diameter of the screen 58 of the inlet 59, and the half strip 60 forming a "T" with the first strip 60. When more strips 60 are used, they are placed over the screen 58 (or the outlet 44 in Step 20) in the configuration of an asterisk to block more of the effective area of the fresh air inlet 59. The one and one-half strips 60 blocked 27% of the area of the inlet 59. Additional blockage of the inlet 59 is referred to as "excessively blocked."

Step 10—Test at blocked inlet—reduced rate

Test Result: pass

The taping steps described with respect to Step 9 (which applied one and one-half strips 60) were repeated.

Step 11—Test at blocked inlet—increased rate

Test Result: fail

Modifications

11A—Enlarge secondary air inlets 38 to 5/16" dia.

11B—Lower baffle 33.

11C—Reset pressure sensor 50 set point from 0.2 to 0.625 inches of water.

Further testing at various percent blockage of the fresh air inlet 59 indicated that more secondary combustion air was required. This was achieved by modification 11A which enlarged each of the four inlets 38 to 5/16 inch.

Next, the upper edge 41 of the baffle 33 was lowered to expose one-half of the area of the inlets 38 to the forced air 30.

Upon further testing, it was found that at a pressure of 0.2 inches of water (sensed by the pressure sensor 50 in its current location/mounting) the burner 36 would turn on at 27% blockage of the fresh air inlet 59. At that amount of blockage and pressure at the entrance 50A, the CO Standard would not be met. The air pressure setting at which the pressure sensor 50 would close the switch 53A was increased so that the switch 53A closed just before the CO Standard was violated when the maximum (27%) blockage occurred at increased rate. For the Model 1690, in the form of Modified Heater I with the modifications 11A and 11B, this pressure was 0.625 inches of water.

The Model 1690, with the modifications of Steps 3, 6 (Modifications 6B and 6C) and 11, is now referred to as the "Modified Heater II".

Step 12—Test at blocked inlet—increased rate

Test Result: pass

This is a retest of the test in Step 11. Step 12 is shown on FIG. 11A.

Step 13—Test at reduced voltage

Initial Test Result: fail (burner 36 would not turn on).

Modifications

13A—Enlarged the inside diameter of the heated air outlet 44.

13B—Reset pressure sensor 50 set point from 0.625 to 0.55 inches of water.

Modification 13A increased such diameter of the heated air outlet 44 from 4 13/16 inches to 5 inches, to a new area of 19.63 square inches.

With this modification, the Model 1690 is referred to as a "Modified Heater III" in FIG. 11B.

Step 14—Test at reduced voltage

Test Result: pass

Modification 13A resulted in reducing the back pressure caused by the heated air outlet 44, reducing the static air pressure in the plenum 29, allowing the set point of the pressure sensor 50 to be reset.

Step 15—Test at blocked inlet—increased rate

Initial Test Result: fail

This step is a repeat of the test of step 12.

Step 16—Test at blocked inlet—reduced rate

Initial Test Result: fail

Modifications

16A—Secured pitot tube 100 at fixed location.

16B—Added tertiary air inlets 42 (ports 92C) and tertiary baffle 97C.

16C—Substituted ports 92A for ports 92C, and baffle 97A for baffle 97C.

Failure to meet the CO Standard in steps 15 and 16 lead to investigation of the mounting and location of the pitot tube 100. The pitot tube 100 was remounted at a fixed position with the open end thereof open toward the forced air 30 to receive the forced air 30. The open end was located at the entrance 50A to the plenum 29 and about one inch from the housing 61 out of the turbulence from the blower 49 and the brackets (not shown) that support the blower motor 51.

With the end of the pitot tube 100 fixed in the housing 61 in a proper location and position for accurate measurement of the pressure (dynamic and static) at the entrance 50A to the plenum 29, tertiary draft 45 was provided first by allowing air to leak into the closed duct 27 where it joins the exhaust outlet (or top) 84 of the combustion chamber 21. Interim testing indicated that such tertiary combustion draft 45 was necessary.

Then, as modification 16B, the ports 92C were made in the inclined section 98 of the bottom 93 of the lower section 65 of the heat exchanger 23. The inclined baffle 97C was secured to the inclined section 98 to cover the ports 92C and block the forced air 30.

Finally, instead of the ports 92C in the inclined section 98 and the inclined baffle 97C, eight of the ports 92A were provided in the bottom 93 and the tertiary baffle 97B (shown in FIG. 12B) Was provided as modification 16C.

The unit with the above-described modifications from steps 1-15 the secured pitot tube 100 and the eight ports 92A is referred to as Modified Heater IV in FIG. 11B.

Step 17—Test at blocked inlet—reduced rate

Test Result: pass

Step 18—Test at blocked inlet—increased rate

Test Result: fail

Modifications

18A—Removed baffle 97B.

18B—Added three more tertiary ports 92A.

Meeting the CO Standard after making modifications 18A and 18B indicated that even more tertiary combustion draft 45 was required under the extreme conditions of steps 11, 12, 15 and 18. Further, the complexity of meeting the CO Standard is indicated by the unexpected need to further modify the Modified Heater III even though step 12 previously resulted in meeting the same test that was later unsuccessfully performed in step 18.

The unit, modified according to step 18, is referred to in FIG. 11B as line "Modified Heater V".

Step 19—Test at blocked inlet—increased rate

Test Result: pass

Step 20—Test at blocked outlet—normal rate

Test Result: pass

"Blocked outlet" refers to sequentially decreasing the effective area of the heated air outlet 44. If the strip method is used, the method is as described with respect to step 9.

Step 21—Test at blocked outlet—reduced rate

Test Result: pass

Step 22—Test at blocked outlet—increased rate

Test Result: fail

Modification

22—Lower the upper temperature limit at which the thermal sensor 54 opens the switch 55. Replaced 190° F. thermal sensor 54 with 170° F. thermal sensor.

Investigation by Applicants indicated that the blocked outlet reduced the rate of fresh air flow in the fresh air path 67 and through the heated air outlet 70. The air in the fresh air path 67 of course receives heat from the heat exchanger 23 in proportion to the flow rate in the fresh air path 67. The reduced fresh air flow rate resulted in a higher operating temperature of the heat exchanger 23, which could become unacceptably high.

The modification in step 22 reduced (to a sensed temperature of 170° F.) the upper temperature limit at which the burner 36 is shut off. With this modification, the Model 1690 was fully modified according to the present invention and became the heater 20.

The following steps indicate that the heater 20 complies with the ANSI Standard, including the CO Standard.

Step 23—Test at blocked outlet—increased rate

Test Result: pass

Step 24—Test at normal input rate

Test Result: pass

Step 25—Test at reduced rate

Test Result: pass

Step 26—Test at increased rate

Test Result: pass

Step 27—Test at reduced voltage

Test Result: pass

Step 28—Test at increased voltage

Test Result: pass

Step 29—Test at blocked inlet—reduced rate

Test Result: pass

Step 30—Test at blocked inlet—increased rate

Test Result: pass

Step 31—Test at blocked inlet—increased rate

Test Result: pass

In summary, Chart 2 below compares the features of the Model 1690 (with the Model 1325B) to the heater 20.

CHART 2

| Feature | Model 1690 with Model 1325B | Heater 20 |
|---|---|---|
| Area of primary combustion air inlet 34 (variable) (sq. in.) | nominally 0.3066 (0.07 in. × 4.38) | 0.241 (0.055 × 4.38 in) (fixed) |
| Area of secondary combustion air inlets 38 (sq. in.) | 0.196 (4 holes @ .25 dia. each) | .306 (4 holes @ 5/16" dia. each) |
| Area of tertiary combustion air inlets (sq. in.) | Zero | 0.135 (eleven 0.125 dia. ports 92A) |
| Upper temperature limit (°F.) read by thermal sensor 54 | 190 | 170 |
| Baffle covers primary inlets 34 | None | Yes |
| Baffle covers ½ of secondary inlets 38 | None | Yes |
| Normal supply voltage 52 (VAC) | 115 | 120 |
| Nominal air pressure (entrance 50A to plenum 29 - inches of water) | 1.05 (appx.) | 0.9 (appx.) |
| Area of heated air outlet 44 (square inches) | 18.19 | 19.63 |
| Rating of heater (BTU) | 52,000 | 45,000 |
| Burner orifice size and (number of orifices) | #56 (5) | #59 (5) |
| CO in combustion products emitted from exhaust stack 64 at normal conditions (115 VAC, normal fuel rate, normal voltage 52, no blockage of fresh air inlet 59 or hot air outlet 44). | Less than 0.08% CO air-free. | Less than 0.08% CO air-free |
| Manifold pressure at normal input rate, (inches of water) | 10 | 10 |
| Compliance with CO Standard | None | Yes, in all tests per CO Standard |
| Air pressure at which pressure sensor 50 closes swith 53A (inches of water) | 0.2 | 0.55 |

OPERATION OF HEATER 20

Before initiating operation, the heater 20 is placed at a location that requires a supply of heated air, or other suitable place if the flexible duct 101 (FIG. 3) is used to guide the heated air to a work location. The primary air inlet 34 and the heated air 70 outlet 44 are checked and cleared of any debris (not shown). The fuel supply components 80A (FIG. 2) are connected to a propane tank (not shown) and the tank output pressure is adjusted to between 5 and 50 psi. The heater 20 is plugged into an electrical supply (not shown) to supply the voltage 52. This starts the motor 51 operating and the blower 49 causes the forced air 30 to flow in the paths 66 and 67. To initiate the heating operation of the heater 20, the switch 63 is set to the "on" position. The blower 49 causes the forced air 30 to flow and the natural draft 35 flows into the primary air inlet 34, natural and forced drafts 40 into the secondary inlets 38 and the natural drafts 45 into the tertiary inlets 42. The forced air 30 at the entrance 50A to the plenum 29 increases the air pressure to the minimum required for closure of the pressure switch 53A (0.55 inches of water for the heater 20) which closes a circuit 102 (FIG. 13) to the controller 56. This energizes the fuel valve 57, which opens to supply the propane 46 to the burner 36. With these conditions, and normal input rate, the controller 56 will energize the igniter 88 and open the fuel valve 57. The propane 46 is supplied to the burner orifices 82 and ignites, producing the flames 26 and the products of combustion 53. The combustion of the propane 46 is supported by (1) the natural combustion draft 35 flowing through the primary air inlet 34, (2) the forced and natural secondary combustion drafts 40 flowing through the secondary inlets 38, and (3) the natural tertiary drafts 45 flowing through the tertiary inlets 42. The baffle 33 is effective to fully block the forced air 30 flowing toward the primary air inlet 34 and to partially block the forced air 30 flowing toward the secondary air inlets 38.

The products of combustion 53 rise and flow through the inlet 22, through the closed duct 27 of the heat exchanger 23 and through the exhaust stacks 64. The heat exchanger 23 is heated by the combustion products 53, and it in turn heats the air in the path 67 so that the heated air exits the outlet 44.

This is the normal operation of the heater 20 that has been shown to produce the products of combustion 53 that meet the CO Standard. The heater 20 will continue to operate meeting the CO Standard even though the input rate drops to 85% of the normal input rate or increases to 112% of the normal input rate. This has been described above as the respective "decreased rate" or "increased rate."

Further, the heater 20 will operate and produce the products of combustion 53 that meet the CO Standard even if the voltage 52 supplied to the heater 20 drops to 85% of nominal (102 VAC) or increases to 110% of nominal (132 VAC).

The fresh air inlet 59 or the heated air outlet 44 may become partially blocked and an uncontrolled situation may simultaneously occur within the predetermined range of the input rate described above, but the CO Standard will be met.

On the other hand, the heater 20 must shut off in the event that the heated air outlet 44 becomes excessively blocked causing the temperature sensed by the thermal sensor 54 in the housing 61 to increase above the 170° F. limit. The thermal sensor 54 senses such over-limit air temperature and opens the second switch 55 causing the circuit 102 to open and deenergize the fuel valve 57 so that it closes to turn off the burner 36.

Similarly, if the fresh air inlet 59 is excessively blocked, the pressure at the entrance 50A to the plenum 29 will drop below the low pressure set point and the pressure sensor 50 will open the switch 53A, which also opens the circuit 102 and deenergizes the fuel valve 57 so that it closes and turns the burner 36 off.

The burner 36 is also turned off if the supply voltage 52 decreases below the predetermined range, because this will cause the pressure at the entrance 50A of the plenum 29 (sensed by the sensor 50) to decrease below the low pressure set point, resulting in burner shut off in a similar manner.

Similarly, an input rate decrease below 85% or increase above 112% of normal input rate may cause the burner 36 to shut off, as follows. As to excessively low input rate, the flames 26 could extinguish or become too small and the flame sensor 89 will cause the burner 36 to shut off. As to excessively high input rate, the thermal sensor 54 could sense a temperature above the upper limit of 170° F. which would cause the burner 36 to shut off.

The second embodiment of the heater 20, shown in FIG. 3 as the heater 20B, also meets the CO Standard for the heater 20B. The temperature limit for the thermal sensor 54 was set at 120° F. Otherwise, the data in Chart 2 applies to the second embodiment 20B.

While the preferred embodiments have been described in order to illustrate the fundamental relationships of the present invention, it should be understood that numerous variations and modifications may be made to these embodiments without departing from the teachings and concepts of the present invention. Accordingly, it should be clearly understood that the form of the present invention described above and shown in the accompanying drawings is illustrative only and is not intended to limit the scope of the invention to less than that described in the following claims.

What is claimed is:

1. In a forced-air, gas-fired hot air construction furnace having:

a burner for supplying the gas, a combustion chamber having an inlet wall and being adapted to contain the gas and products of combusting the gas, a plenum for receiving forced draft combustion air and directing the forced draft combustion air toward said combustion chamber, a closed duct having an exhaust inlet for receiving the combustion products and an exhaust outlet for discharging the combustion products, means for guiding air to be heated over said closed duct, means for supplying forced air to said guiding means and to said plenum, means for discharging the heated air from said guiding means, means for sensing the pressure of the forced air in said supplying means, and means for sensing an operating temperature in said guiding means; the improvement in said furnace comprising:

means for rendering said furnace capable of operating without manual adjustment of air flow to said combustion chamber, such operation of said furnace being in compliance with a selected standard which does not permit such manual adjustment but which limits the maximum percent of a given chemical compound which is permitted to exit said exhaust outlet when the rate of supplying the gas to said burner varies within a defined range and when voltage supplied to said supplying means varies within a preset range and causes variation of the pressure at which the forced air is supplied, such variation being relative to a low limit, said rendering means comprising:

combustion air inlet means provided in said inlet wall of said combustion chamber and having separate fixed inlet areas for admitting draft combustion air to said combustion chamber at first, second and third locations that are progressively closer and closer to said exhaust inlet to said closed duct;

baffle means mounted close to said wall of said combustion chamber for selectively blocking the forced draft in said plenum so that only natural draft air is admitted to said first and third locations and both forced and natural draft air are admitted to said second location;

said pressure sensing means being adjusted for responding to pressure of the forced air below the low limit, said low limit pressure being the lowest pressure at which said maximum percent of the given chemical compound does not appear in the combustion products exiting said exhaust outlet;

said temperature sensing means being adjusted for responding to the operating temperature exceeding a selected maximum temperature, said maximum temperature being selected to permit the pressure of the gas supplied to said burner to be at a maximum required by said selected standard when said forced air pressure is at the lowest required by said selected standard; and means responsive separately to said pressure sensing means responding to pressure below said low limit or to said temperature sensing means responding to an operating temperature above said maximum temperature for interrupting the operation of said burner.

2. In a furnace according to claim 1, the further improvement comprising:

said discharging means having a fixed area selected to enable said furnace to comply with said selected standard.

3. A method of rendering a forced-air, gas-fired hot air construction heater capable of operating in conformance with an emissions standard, said heater having a burner for supplying the gas, a combustion chamber having an inlet wall and being adapted to contain the gas and products of combusting the gas in first, second and tertiary combustion zones, a plenum for receiving forced draft combustion air and supplying forced draft combustion air to said combustion chamber, a closed duct having an inlet for receiving the combustion products and an exhaust outlet for discharging the combustion products, means for guiding air to be heated over said closed duct, means for supplying forced draft air to said guiding means and to said plenum, manually adjustable means for admitting primary combustion forced air from said plenum into said first combustion zone, means for discharging the heated air from said guiding means, means for sensing the pressure of the forced air in said guiding means, means for sensing the operating temperature in said closed duct as said duct receives the combustion products, said method rendering said heater capable of operating without manual adjustment of said means for admitting the primary combustion forced air, such operation of said heater being in compliance with the emissions standard, the emissions standard not permitting such manual adjustment, the emissions standard limiting the maximum percent of a given chemical compound which is permitted to exit said exhaust outlet when the rate of supplying the gas to said burner varies within a predetermined rate range and when said forced air supplying means supplies the forced air at varying pressure within a predetermined pressure range, said method comprising:

blocking the forced draft air flowing in said plenum toward said admitting means so that only natural draft air flows toward said admitting means and into said first combustion zone of said combustion chamber;

fixing the area of said admitting means at a selected non-variable area;

providing in said wall of said combustion chamber secondary combustion air inlet means having separate second fixed inlet areas for admitting secondary combustion air to said second zone of said combustion chamber;

partially blocking the forced draft air flowing in said plenum toward said secondary combustion air inlet means to permit both forced draft air and natural draft air to enter said separate second fixed inlet areas;

providing in said inlet wall or said closed duct third fixed tertiary combustion air inlet means for admitting natural draft tertiary combustion air to said third combustion zone of said combustion chamber;

adjusting said pressure sensing means for interrupting operation of said burner when the pressure of the forced draft air decreases below a specified pressure, said specified pressure being the lowest forced draft air pressure at which said maximum percent of the given chemical compound does not appear in the combustion products exiting said exhaust outlet; and said adjusting temperature sensing means for interrupting operation of said burner when the operating temperature in said guiding means exceeds a selected maximum temperature, said maximum temperature being selected to permit the pressure of the gas supplied to said burner to be at the maximum end of said predetermined rate range defined by said selected standard.

4. A portable gas-fired construction heater for supplying heated fresh air separately from products of combustion produced by said heater, said heater being designed to operate so that the products of combustion do not exceed a given exhaust standard for the products of combustion when the actual input rate of supply of gas to a burner of said heater varies in a preset range that extends above and below a standard rate of supply and when the voltage supplied to the heater varies in a defined range that extends above and below a standard voltage, said burner producing spaced flames during combustion of the gas, said heater comprising:

a heat exchanger defining a first closed path for fresh air to be heated and a second closed path for the products of combustion;

a combustion chamber housing said burner so that the spaced flames are directed toward said heat exchanger, said chamber being connected to said heater exchanger to direct products of combustion into said second closed path, said combustion chamber having primary and secondary combustion zones, said second closed path of said heat exchanger and said combustion chamber combining to define a tertiary combustion zone;

first combustion air inlet means provided in said combustion chamber for supplying natural draft combustion air to said primary zone;

second combustion air inlet means provided in said combustion chamber, said second means including a plurality of secondary air inlets formed in said combustion chamber for supplying forced and natural draft combustion air to said secondary zone, one of said secondary air inlets being opposite each of the spaces between adjacent ones of the spaced flames;

a plurality of tertiary air inlets for supplying natural draft tertiary combustion air to said tertiary combustion zone; p1 first means for sensing the pressure of the air supplied to the heater, said pressure being variable relative to a low pressure limit, and means responsive to said first sensing means for rendering said burner inoperative when the actual pressure of the air supplied to the heater is below the low pressure limit.

5. A portable gas-fired construction heater for supplying heated fresh air separately from products of combustion produced by said heater, said heater being designed to operate so that the products of combustion do not exceed a given exhaust standard for the products of combustion when the actual input rate of supply of gas to a burner of said heater varies in a preset range that extends above and below a standard rate of supply and when the voltage supplied to the heater varies in a defined range that extends above and below a standard voltage, said exhaust standard being a carbon monoxide standard for gas-fired construction heaters, said burner producing spaced flames during combustion of the gas, said heater comprising:

a heat exchanger defining a first closed path for fresh air to be heated and a second closed path for the products of combustion;

a combustion chamber housing said burner so that the spaced flames are directed toward said heat exchanger, said chamber being connected to said heater exchanger to direct products of combustion into said second closed path, said combustion chamber having primary and secondary combustion zones, said second closed path of said heat exchanger and said combustion chamber combining to define a tertiary combustion zone;

first combustion air inlet means provided in said combustion chamber for supplying natural draft combustion air to said primary zone;

second combustion air inlet means provided in said combustion chamber, said second means including a plurality of secondary air inlets formed in said combustion chamber for supplying forced and natural draft combustion air to said secondary zone, one of said secondary air inlets being opposite each of the spaces between adjacent ones of the spaced flames;

a plurality of tertiary air inlets for supplying natural draft tertiary combustion air to said tertiary combustion zone;

a blower responsive to the voltage to provide the air for combustion at a pressure that varies relative to a low limit;

means for sensing the pressure of the air for combustion; and means responsive to said sensing means for rendering said burner inoperative when the actual pressure decreases below the defined range so that the actual pressure of the air provided by the blower is below the low limit.

6. A heater for supplying heated air separately from products of combustion, wherein the products of combustion are permitted to contain no more than a specified percent of a selected chemical compound when selected uncontrolled heater operating conditions are within predetermined ranges, said uncontrolled operating conditions including variations in fuel rate within a predetermined rate range and variations in fresh air pressure within a predetermined pressure range, said fresh air pressure being the pressure of the air forming said natural air drafts and forced air drafts to said zones, said heater comprising:

a combustion chamber for producing said products of combustion, said chamber having primary and secondary combustion zones;

a heat exchanger for receiving said products of combustion and transferring heat therefrom to fresh air to be heated;

said chamber and said heat exchanger defining a tertiary combustion zone;

means for supplying a separate natural air draft to each of said primary and tertiary combustion zones and for supplying a separate partially natural and partially forced air draft to said secondary combustion zones, said means including first and third fixed-area inlets for respectively supplying said separate natural air drafts to said primary, and tertiary combustion zones and a second fixed-area inlet for supplying the air to said secondary combustion zone, the fixed-area of each of said inlets being selected so that said specified percent is not exceeded during operation of said heater when said uncontrolled variations of said fuel pressure and said fresh air pressure are within said responsive predetermined rate and pressure ranges;

a burner within said combustion chamber;

means for sensing said fresh air pressure; and means responsive to said sensing means for rendering said burner inoperative when the actual fresh air pressure is lower than said predetermined pressure range.

7. A heater for supplying heated air separately from products of combustion, wherein the products of combustion are permitted to contain no more than a specified percent of a selected chemical compound when selected uncontrolled heater operating conditions are within predetermined ranges, said uncontrolled operating conditions including variations in fuel rate within a predetermined rate range and variations in fresh air pressure within a predetermined pressure range, said heater comprising:

a combustion chamber for producing said products of combustion, said chamber having primary and secondary combustion zones;

a heat exchanger for receiving said products of combustion and transferring heat therefrom to fresh air to be heated;

said chamber and said heat exchanger defining a tertiary combustion zone;

means for supplying a separate natural air draft to each of said primary and tertiary combustion zones and for supplying a separate partially natural and partially forced air draft to said secondary combustion zones, said means including first and third fixed-area inlets for respectively supplying said separate natural air drafts to said primary, and tertiary combustion zones and a second fixed-area inlet for supplying the air to said secondary combustion zone, the fixed-area of each of said inlets being selected so that said specified percent is not exceeded during operation of said heater when said uncontrolled variations of said fuel pressure and said fresh air pressure are within said respective predetermined rate and pressure ranges;

wherein voltage is supplied to said heater and may vary relative to a predetermined voltage range;

a burner within said combustion chamber;

a blower responsive to the voltage to provide the natural air draft to said zones and the forced air draft to said secondary zone for combustion, the air being provided at a pressure which may vary relative to a lower pressure limit;

means for sensing the pressure of the air provided by said blower for combustion; and means responsive to said sensing means for rendering said burner inoperative when the pressure of the air from said blow is below the low pressure limit.

8. A portable gas-fired construction heater for supplying heated fresh air separately from products of combustion produced by said heater, said heater being designed to operate so that the products of combustion do not exceed a given exhaust standard for the products of combustion when the actual input rate of supply of gas to a burner of said heater varies in a preset range that extends above and below a standard rate of supply and when the voltage supplied to the heater varies in a defined range that extends above and below a standard voltage, said burner pouring spaced flames during combustion of the gas, said heater comprising:

a heat exchanger defining a first closed path for fresh air to be heated and a second closed path for the products of combustion;

a combustion chamber housing said burner so that the spaced flames are directed toward said heat exchanger, said chamber being connected to said heater exchanger to direct products of combustion into said second closed path, said combustion chamber having primary and secondary combustion zones, said second closed path of said heat exchanger and said combustion chamber combining to define a tertiary combustion zone;

first combustion air inlet means provided in said combustion chamber for supplying natural draft combustion air to said primary zone;

second combustion air inlet means provided in said combustion chamber, said second means including a plurality of secondary air inlets formed in said combustion chamber for supplying forced and natural draft combustion air to said secondary zone, one of said secondary air inlets being opposite each of the spaces between adjacent ones of the spaced flames;

a plurality of tertiary air inlets for supplying natural draft tertiary combustion air to said tertiary combustion zone;

a blower responsive to the voltage to provide the air for combustion at a pressure that varies relative to a low limit;

a thermal sensor set to respond to heat from the heated fresh air and said heat exchanger in excess of a selected maximum temperature, said maximum temperature being selected to allow operation of said heater when the actual input rate of supply of the gas is at the high end of the preset range and the pressure of the combustion air provided by said blower is at said low limit; and a burner control circuit including said thermal sensor, said circuit rendering said burner inoperative when said thermal sensor responds to said heat in excess of said selected temperature.

* * * * *